US005819134A

United States Patent [19]

Sato et al.

[11] Patent Number: 5,819,134

[45] Date of Patent: Oct. 6, 1998

[54] FIXING APPARATUS HAVING A TEMPERATURE CONTROL SYSTEM FOR A PLURALITY OF HEATERS

[75] Inventors: Kaoru Sato; Junichi Kimizuka, both of Yokohama; Tatsuto Tachibana, Kawasaki; Hiroaki Sakai, Yokohama, all of Japan

[73] Assignee: Canon Kabushiki Kaisha, Tokyo, Japan

[21] Appl. No.: 673,270

[22] Filed: Jun. 28, 1996

[30] Foreign Application Priority Data

Jun. 30, 1995 [JP] Japan ..... 7-186583
Oct. 19, 1995 [JP] Japan ..... 7-271280

[51] Int. Cl.[6] ..... G03G 15/20

[52] U.S. Cl. ..... 399/69; 399/70; 399/330; 399/334

[58] Field of Search ..... 399/67, 69, 330, 399/334, 70

[56] References Cited

U.S. PATENT DOCUMENTS

| | | | |
|---|---|---|---|
| 5,041,718 | 8/1991 | D'Hondt et al. | 399/330 |
| 5,334,817 | 8/1994 | Nakamori et al. | 219/492 |
| 5,359,400 | 10/1994 | Itoh et al. | 399/23 |

FOREIGN PATENT DOCUMENTS

| | | |
|---|---|---|
| 60-249175 | 12/1985 | Japan . |
| 61-59379 | 3/1986 | Japan . |
| 61-59380 | 3/1986 | Japan . |
| 62-135866 | 6/1987 | Japan . |
| 3-94287 | 4/1991 | Japan . |
| 7-181832 | 7/1995 | Japan . |

*Primary Examiner*—Nestor R. Ramirez
*Attorney, Agent, or Firm*—Fitzpatrick, Cella, Harper & Scinto

[57] ABSTRACT

The present invention provides an image heating apparatus comprising a first heater, a second heater having a heat generating distribution different from that of the first heater, a heated member to be heated by the first heater and second heater, a temperature detection element for detecting a temperature of the heated member, and a power supply controlling means for controlling power supply to the first heater and second heater on the basis of a temperature detected by the temperature detection element. The power supply controlling means serves to stop the power supply to the first heater when the temperature detected by the temperature detection element reaches a first temperature, and to stop the power supply to the second heater when the temperature detected by the temperature detection element reaches a second temperature different from the first temperature.

11 Claims, 27 Drawing Sheets tth : DETECT TEMP. (THERMISTOR INPUT, TEMP. CHANGE VALUE)
tm on : MAIN HEATER HEATING START TEMP.
tm off: MAIN HEATER HEATING STOP TEMP.
ts on : SUB HEATER HEATING START TEMP.
ts off: SUB HEATER HEATING STOP TEMP.

tth : DETECT TEMP. (THERMISTOR INPUT, TEMP. CHANGE VALUE)
t on : HEATER HEATING START TEMP.
t off : HEATER HEATING STOP TEMP.
T : TIMER COUNT VALUE
Ts off: SUB-MAIN CHANGE TIMING (SUB HEATER HEAT TIME)

tth : DETECT TEMP. (THERMISTOR INPUT, TEMP. CHANGE VALUE)
t on : HEATER HEATING START TEMP.
t off : HEATER HEATING STOP TEMP.
T : TIMER COUNT VALUE
Ts off : SUB-MAIN CHANGE TIMING (SUB HEATER HEAT TIME)

u :HEATER CONTROL ONE UNIT TIME

T :TIMER COUNT VALUE

Ts off:SUB-MAIN CHANGE TIMING $t_{th}$ : DETECT TEMP. (THERMISTOR INPUT, TEMP. CHANGE VALUE)
t on : HEATER HEATING START TEMP.
t off: HEATER HEATING STOP TEMP.
$t_{ch}$ : SUB-MAIN CHANGE TIMING (SUB HEATER HEAT TIME)

$t_{th}$ : DETECT TEMP. (THERMISTOR INPUT, TEMP. CHANGE VALUE)
t on : HEATER HEATING START TEMP.
t off: HEATER HEATING STOP TEMP.
T : TIMER COUNT VALUE
$t_{ch}$ : SUB-MAIN CHANGE TEMP.

Ts on:SUB HEATER HEATING TIME
Tm on:MAIN HEATER HEATING TIME
tch :SUB-MAIN CHANGE TEMP.
Δt :SUB-MAIN CHANGE TEMP. ADJUST AMOUNT tth : DETECT TEMP. (THERMISTOR INPUT, TEMP. CHANGE VALUE)
t on : HEATER HEATING START TEMP.
ts off : SUB HEATER HEATING STOP TEMP.
tm off : MAIN HEATER HEATING STOP TEMP.
T : TIMER COUNT VALUE
Ts on : SUB HEATER HEATING TIME
Tm on : MAIN HEATER HEATING TEMP.

Ts on :SUB HEATER HEATING TIME
Tm on :MAIN HEATER HEATING TIME
Δt :MAIN HEATING STOP TEMP. ADJUST AMOUNT
tm off:MAIN HEATER HEATING STOP TEMP.

FIXING APPARATUS HAVING A TEMPERATURE CONTROL SYSTEM FOR A PLURALITY OF HEATERS

BACKGROUND OF THE INVENTION

1. Field of the Invention

The present invention relates to an image heating apparatus for heating an image born on a recording material.

2. Related Background Art

An example of a conventional image heating apparatus used as a fixing device for copying machines, printers and the like is shown in FIG. 1.

In FIG. 1, a heat roller 1 comprises a core cylinder 11 made of aluminium, iron or the like, and a mold releasing resin layer made of PFA, PTFE or the like and coated on the core cylinder and is heater by a heater 4 from the inside. A temperature of the heat roller 1 is detected by a temperature detection element 3 (contacted with the heat roller 1) as a surface temperature of the heat roller 1, and, the surface temperature is controlled to a predetermined level by intermittently energizing the heater 4 by means of a temperature control circuit (not shown). In image heating apparatuses having a cleaning means, the temperature detection means 3 can be disposed within a recording material passing area; whereas, in image heating apparatuses having no cleaning means, the temperature detection means is normally disposed at a non-image forming area out of the passing area in order to prevent image deterioration.

On the other hand, a pressure roller 2 urged against the heat roller 1 and driven by rotation of the latter comprises a metal core cylinder 13 made of aluminium, iron or the like, an elastic layer 14 made of silicone rubber, silicone sponge or the like having heat-resistivity and low hardness and coated on the core cylinder, and a coating layer 15 made of resin such as PFA, PTFE or the like having high mold releasing ability and coated on the elastic layer.

A recording material P on which a toner image T was born is introduced into a nip between the heat roller 1 and the pressure roller 2 through an inlet guide 6. In the nip, the toner image is fixed to the recording material with heat and pressure. The inlet guide 6 has a guide surface constituted by resistance reducing material such as PBT (having resistance of 10E8 Ω to 10E10 Ω) or by metal such as stainless steel, and, generally, the resistance reducing material is used at a contact point between a fixing frame and the guide. The reason is that, if the inlet guide is formed from insulation material, the guide surface is charged by the sliding contact between the guide and the recording material, thereby causing the scattering of toner. Further, in order to prevent the formation of wrinkle in the recording material P when the recording material is being passed through the nip, inverted crown configurations are adopted to the heat roller 1 and the pressure roller 2, and an entrance position where the recording material enters into the nip is made optimum by the inlet guide 6.

However, in the arrangement using the single heater as shown in FIG. 1, there arises a problem that non recording material passing areas are excessively heated when a recording sheet having small size is passed through the nip. Particularly, in high speed copying machines, when the recording materials having small size are continuously printer, the temperature of the non passing areas is excessively increased.

To avoid this, fixing devices including a plurality of heaters having different heat generating distribution has been proposed. Now, an example of the fixing device of this kind will be described with reference to FIG. 2 which is a sectional view of the fixing device and FIG. 3 which is a view showing heat generating distribution of two heaters and segment arrangements.

In this case, the heat generation when the recording sheet is conveyed on the basis of the center reference is shown. A heater 4*a* is used when the recording material having small size is printed so that a portion in which the heat is absorbed by the recording material is subjected to stronger heat. A heater 4*b* is used together with the heater 4*a* when a larger size recording material is printed. With this arrangement, since the heat generating distribution is changed in accordance with the size of the recording material, the temperature of the non passing areas can be prevented from being increased excessively.

On the other hand, also in a stand-by condition before the toner image is heated and fixed, it is necessary that the heat roller is heated by energizing the heaters. In the stand-by condition, it is preferable that two heaters are alternately energized in order to minimize the power consumption.

However, as shown in FIG. 2, a distance between a high temperature generating area of the heater 4*a* and the temperature detection element 3 differs from a distance between a high temperature generating area of the heater 4*b* and the temperature detection element 3. Accordingly, if the energization (power supply) of the two heaters 4*a*, 4*b* is controlled to maintain a single target temperature, the energization time of the heater 4*a* will be different from the energization time of the heater 4*b*. More specifically, in the arrangement shown in FIG. 2, when the heater 4*b* is energized, the temperature detection element 3 reaches the target temperature for a relatively short time, but, when the heater 4*a* is energized, it takes a long time for attaining the target temperature of the temperature detection element 3. That is to say, the energization time of the heater 4*a* becomes longer than that of the heater 4*b*, thereby causing the difference in service life between the two heaters.

SUMMARY OF THE INVENTION

The present invention aims to eliminate the above-mentioned conventional drawbacks, and an object of the present invention is to provide an image heating apparatus which can minimize the difference in service life between two heaters.

Another object of the present invention is to provide an image heating apparatus comprising a first heater, a second heater having heat distribution different from that of the first heater, a heated member heated by the first and second heaters, a temperature detection element for detecting a temperature of the heated member, and a power supply (energization) controlling means for controlling power supply of the first and second heaters on the basis of a temperature detected by the temperature detection element, Wherein the power supply controlling means serves to stop the power supply to the first heater when the temperature detected by the temperature detection element reaches a first temperature and to stop the power supply to the second heater when the temperature detected by the temperature detection element reaches a second temperature different from the first temperature.

A further object of the present invention is to provide an image heating apparatus comprising a first heater, a second heater having heat distribution different from that of the first heater, a heated member heated by the first and second heaters, a temperature detection element for detecting a temperature of the heated member, and a power supply (energization) controlling means for controlling power supply of the first and second heaters on the basis of a temperature detected by the temperature detection element. Wherein the power supply controlling means serves to energize the second heater for a predetermined time period when a detected temperature detected by the temperature detection element is lowered below a first temperature and to energize the first heater until the detected temperature reaches a second temperature higher than the first temperature, after the predetermined time period is elapsed.

A still further object of the present invention is to provide an image heating apparatus comprising a first heater, a second heater having heat distribution different from that of the first heater, a heated member heated by the first and second heaters, a temperature detection element for detecting a temperature of the heated member, and a power supply (energization) controlling means for controlling power supply of the first and second heaters on the basis of a temperature detected by the temperature detection element. Wherein the power supply controlling means serves to energize the second heater until a detected temperature detected by the temperature detection element reaches a second temperature after the detected temperature is lowered below a first temperature and to energize the first heater until the detected temperature reaches a third temperature higher than the second temperature.

The other objects and features of the present invention will be apparent from the following detailed explanation of the invention referring to the accompanying drawings.

DETAILED DESCRIPTION OF THE PREFERRED EMBODIMENT

Figure 1:
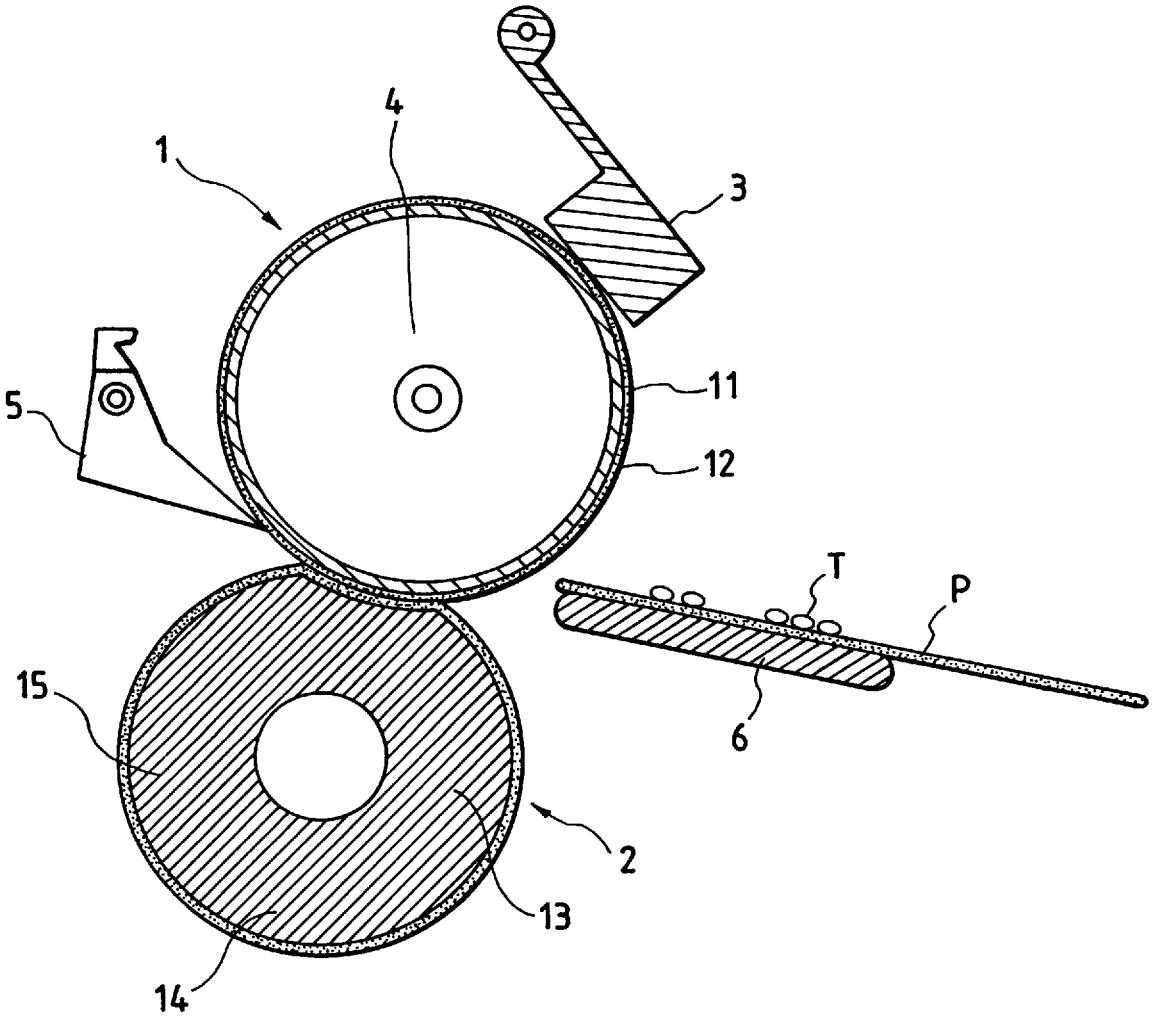
FIG. 1 PRIOR ART
FIG. 1 is a sectional view of a fixing device having a single heater.
Figure 2:
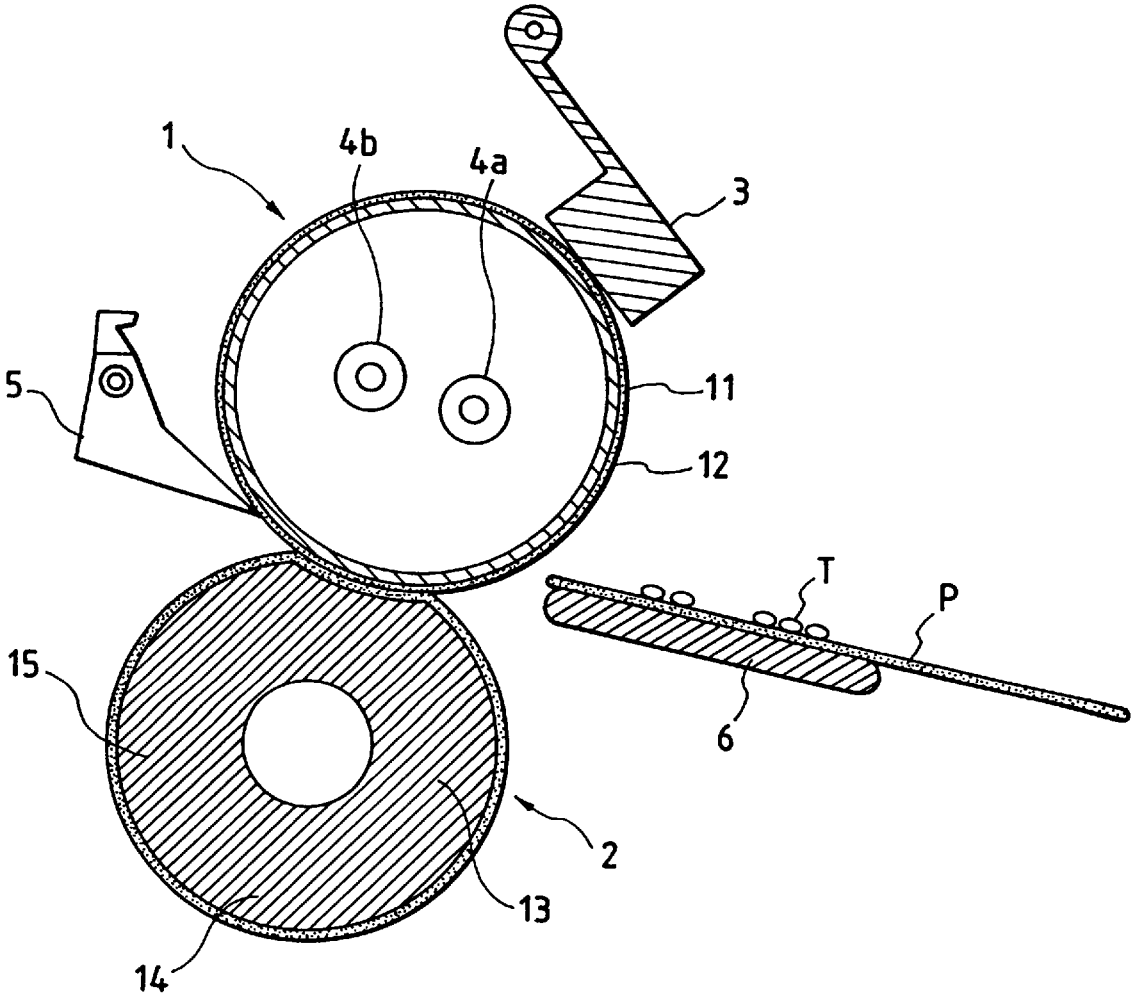
FIG. 2 is a sectional view of a fixing device having two heaters.
Figure 3:
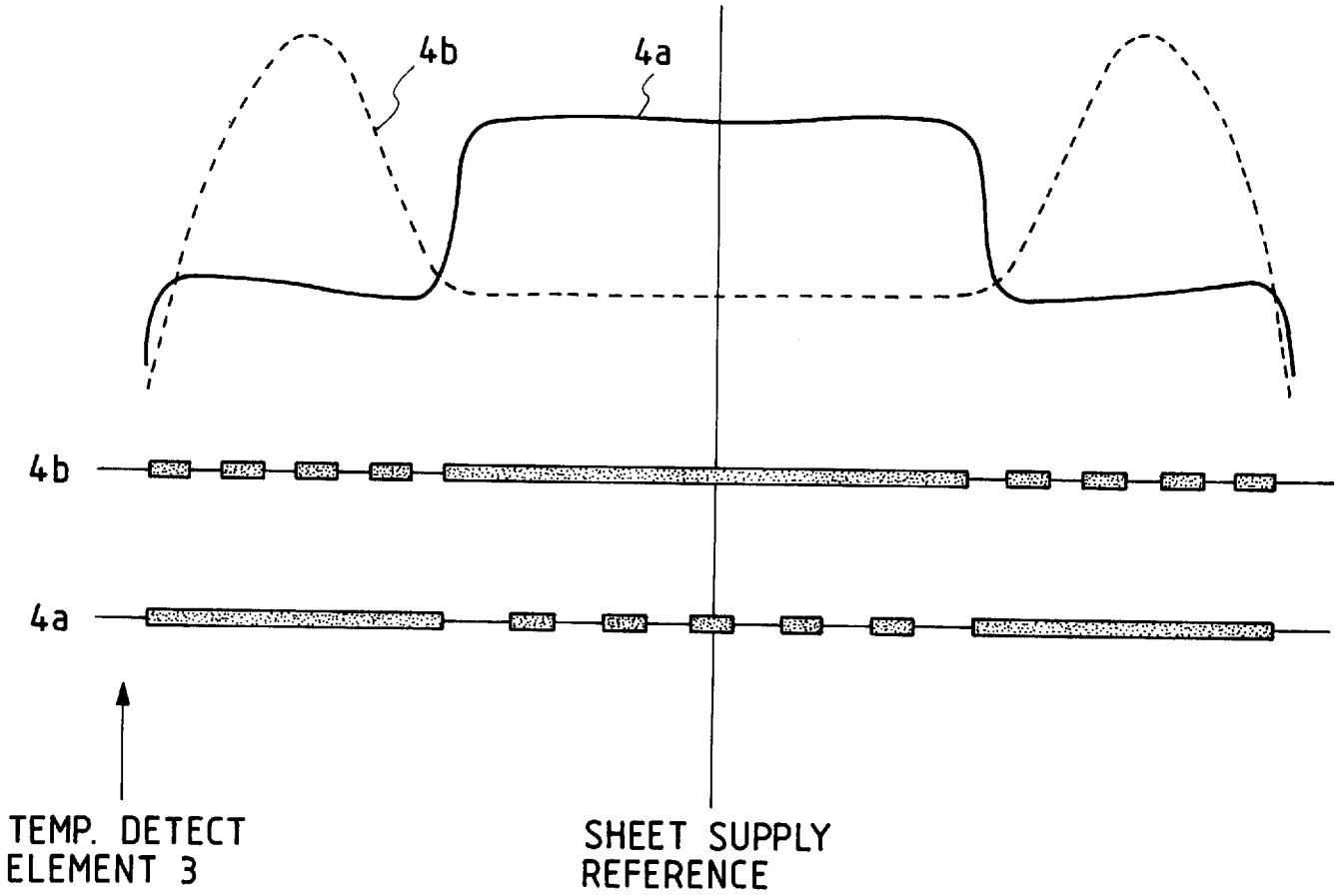
FIG. 3 is an explanatory view showing longitudinal heat generating distribution of the two heaters and segment arrangements.
Figure 4:
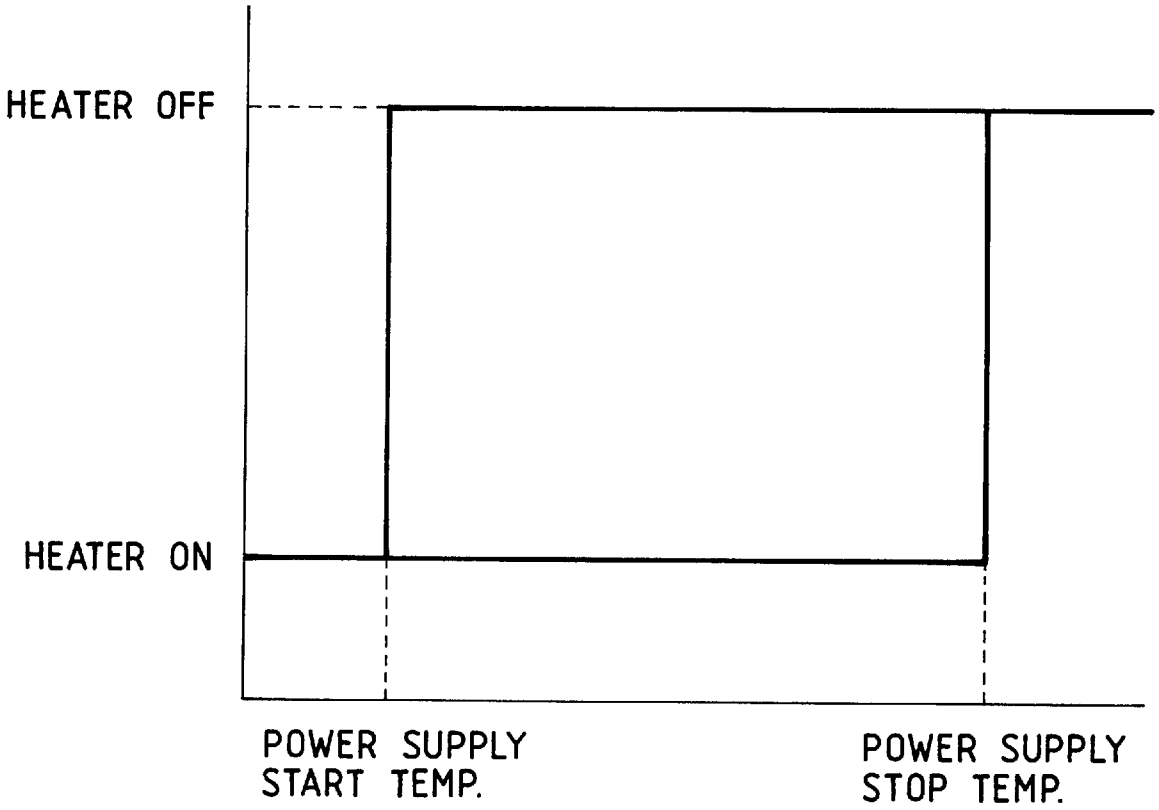
FIG. 4 is an explanatory view showing a heater power supply condition upon hysteresis drive.

Since a sectional view, and, heat generating distribution and segment arrangements of heaters according to a first embodiment of the present invention are the same as those shown in FIGS. 2 and 3 previously described, the first embodiment of the present invention will be explained with reference to FIGS. 2 and 3.

A fixing device according to the first embodiment has a maximum sheet supply size of A3 (297 mm) and utilizes a center of a recording material (recording sheet) as a sheet supply reference. Further, the heat generating distribution is symmetrical with respect to the sheet supply reference. Heaters (heating bodies) 4*a*, 4*b* each has a rated power of 500 W. A fixing roller (heater member) 1 comprises a core cylinder 11 having a diameter of 40 mm and a mold releasing layer 12 coated on the core cylinder and having a thickness of 1.0 mm and made of PFA. A pressure roller 2 comprises a core cylinder 13 made of stainless steel, an elastic layer 14 coated on the core cylinder and made of silicone sponge, and a mold releasing layer 15 coated on the elastic layer and made of PFA. The pressure roller has a diameter of 30 mm and a hardness of 50° so that, when the pressure roller is urged against the fixing roller with pressure of 170 N, a nip having a width of 5.0 mm is formed between these rollers. Since a temperature detection element is disposed out of an image forming area, toner is not adhered to the temperature detection element, and, thus, the cleaning of the temperature detection element is not required.

Figure 5:
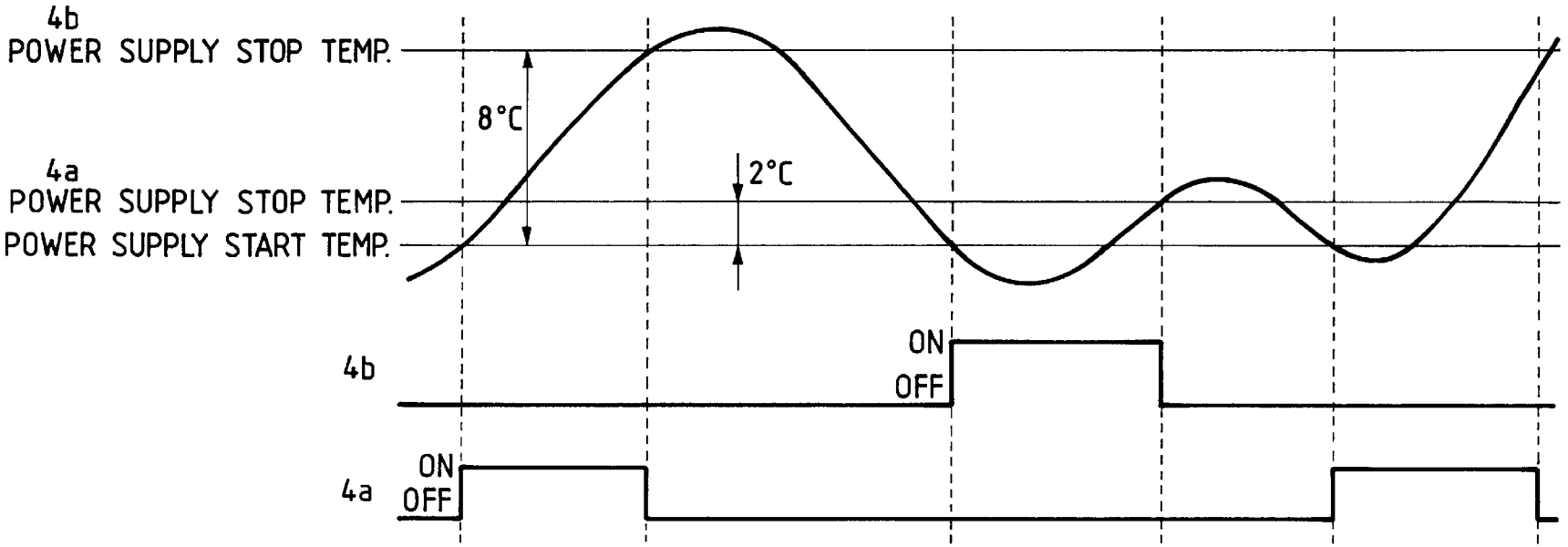
FIG. 5 is an explanatory view showing a relation between a temperature detected by a temperature detection element and a drive condition of two heaters.

Since the main heat generating area of the heater 4*a* is disposed relatively remote from the temperature detection element, when the heater 4*a* is operated, a temperature of a temperature detection position is relatively hard to be increased; whereas, since the heat generating area of the heater 4*b* is disposed nearer to the temperature detection element, when the heater 4*b* is operated, the temperature of the temperature detection position is apt to be increased. Thus, regarding the heaters 4*a*, 4*b*, by providing different hysteresis widths (i.e. by setting heater power supply start temperatures different from heater power supply stop temperatures), the operation times of the heaters can be substantially the same. As an example of the setting of the operation conditions of the heaters, FIG. 5 shows a relation between the temperature of the temperature detection element and ON/OFF timings of the heaters 4*a*, 4*b*. By providing the hysteresis width of 2° C. for the heater 4*a* and the hysteresis width of 8° C. for the heater 4*b*, the operation (drive) ratio of the heaters substantially the same. Thus, in comparison with the temperature adjustment by using a single heater, the operation ratio of the heaters can be reduced to ½ or less (i.e. the service lives of the heaters can be extended by twice or more).

Further, regarding the setting values of the hysteresis, although 4*a*:4*b*=1° C.:4° C. can be used, in this case, since the number of ON/OFF operations of each heater becomes about twice, when the voltage fluctuation on the same electric power is taken into account, the former setting resulting in the fewer number of ON/OFF operations is preferable.

Figure 6:
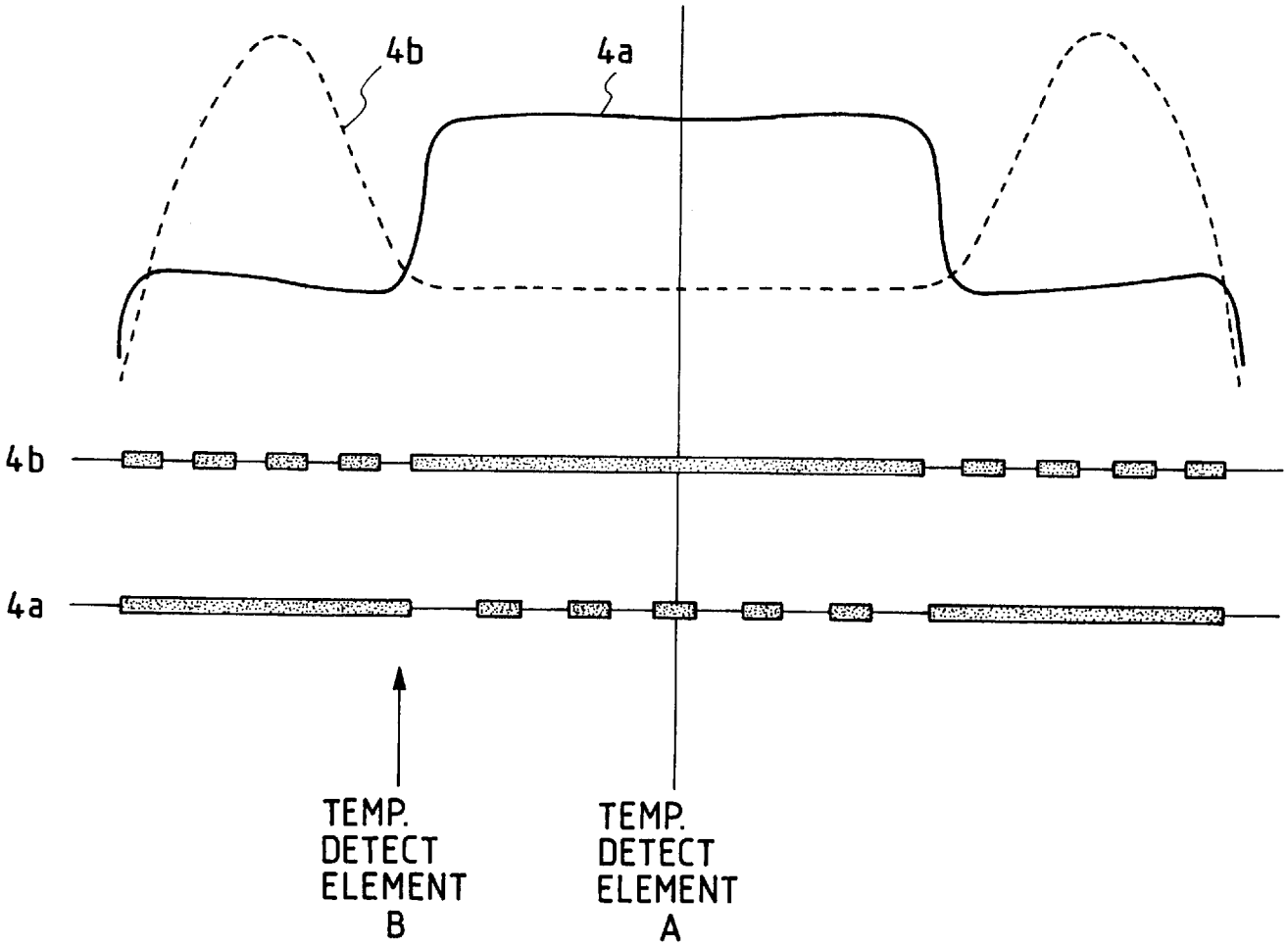
FIG. 6 is an explanatory view showing a longitudinal positional relation between the temperature detection element and the heater when the temperature detection element is disposed in a sheet supply area.

Next, a second embodiment of the present invention will be explained. In this second embodiment, the temperature detection element is disposed at a center (A in FIG. 6). When the temperature detection element is disposed at the center, unlike to the above-mentioned eccentric temperature adjustment, the increase in temperature of the temperature detection position by the heater 4*a* becomes faster, and the increase in temperature of the temperature detection position by the heater 4*b* becomes slower. Thus, in such a case, by setting the hysteresis temperature widths contrary to the above, the same technical advantage as the first embodiment can be achieved.

Next, a third embodiment of the present invention will be explained. Also in this third embodiment, the temperature detection element is disposed in the sheet supply area. However, in this embodiment, the temperature detection element is particularly arranged at a junction between the main heat generating areas of the heaters 4*a*, 4*b* (B in FIG. 6). In this case, since the change in temperature regarding the operations of the heaters becomes the same, by setting the same hysteresis temperature widths regarding the heaters, the same technical advantage as the first embodiment can be achieved.

Figure 7:
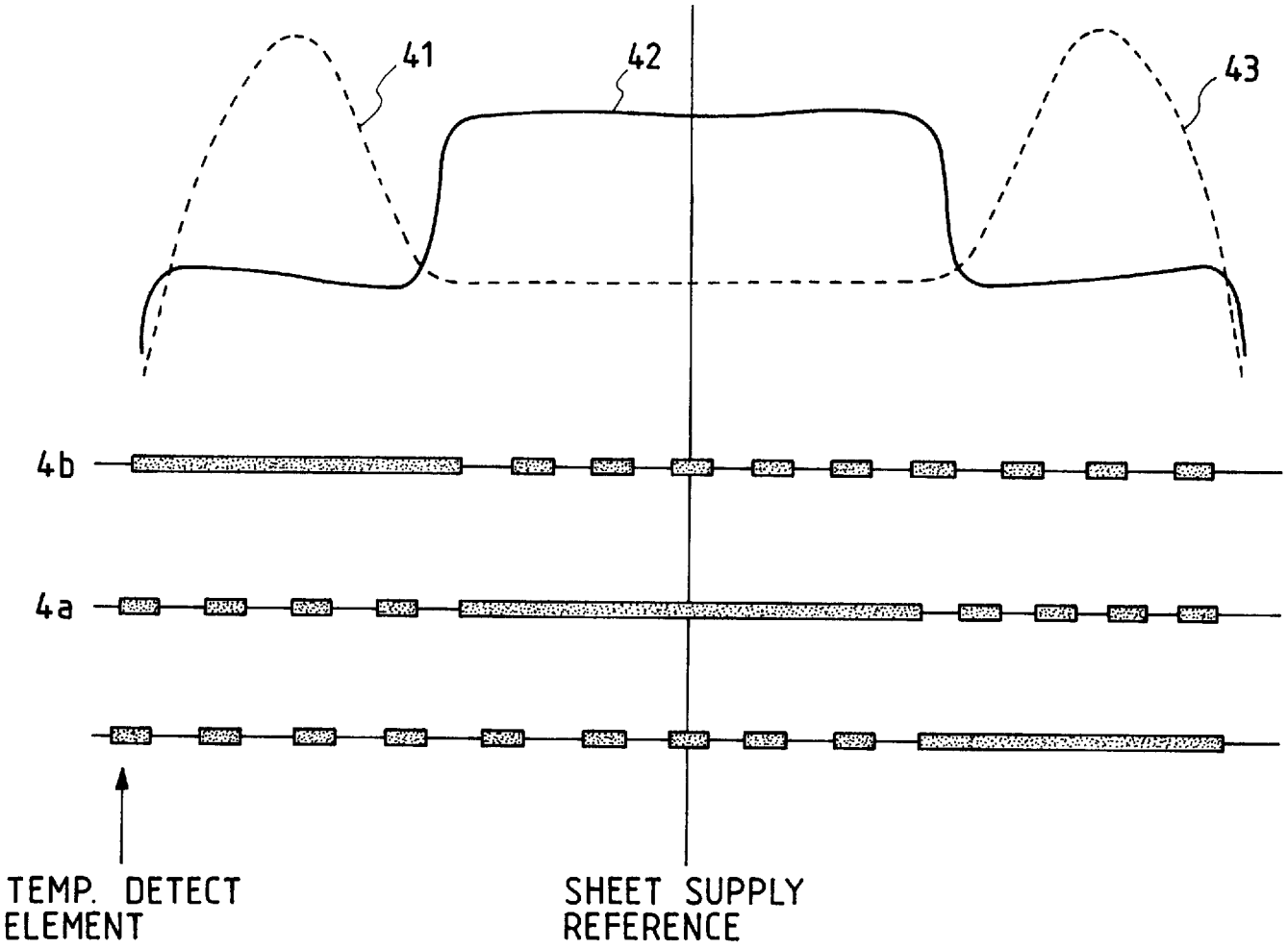
FIG. 7 is an explanatory view showing longitudinal heat generating distribution of the three heaters and segment arrangements.
Figure 8:
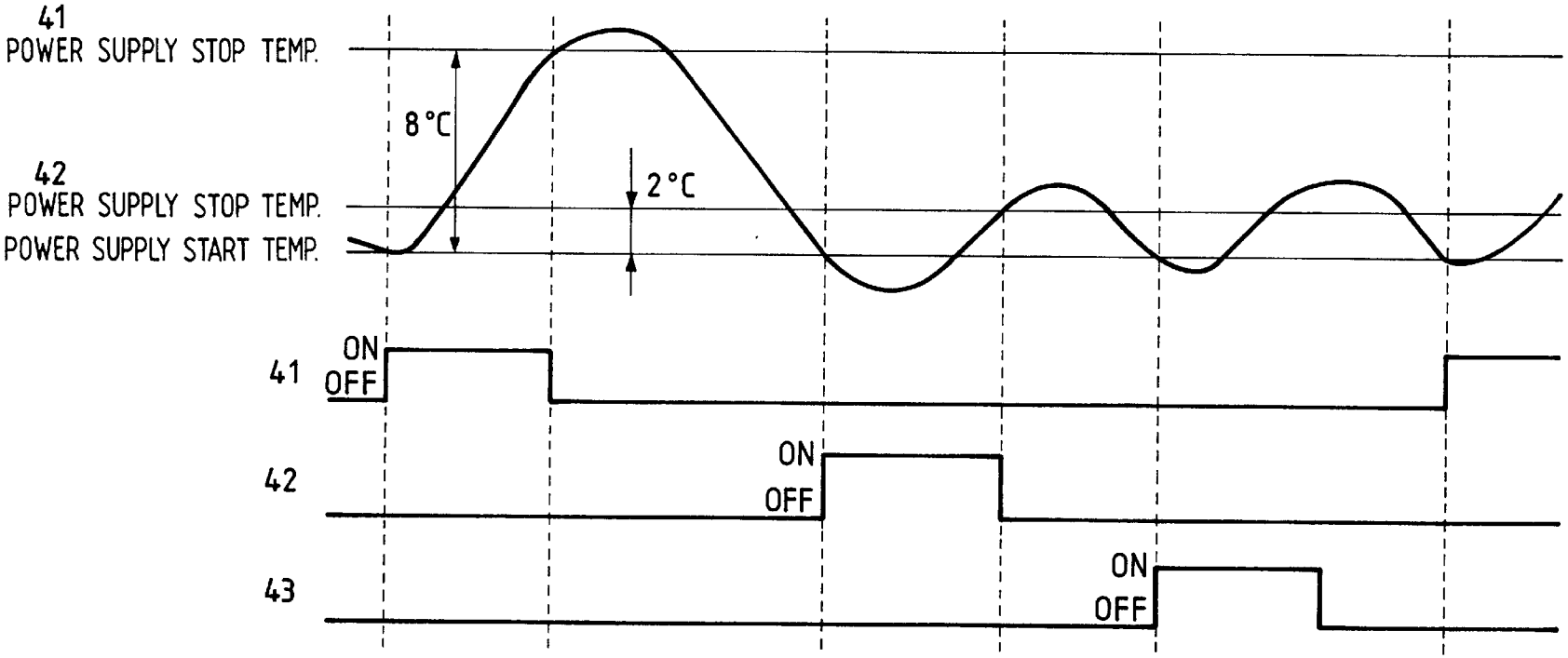
FIG. 8 is an explanatory view showing a relation between a temperature detected by a temperature detection element and a drive condition of three heaters.

Next, a fourth embodiment of the present invention will be explained. In this fourth embodiment, in case of high speed copying machines, when two heaters are used as mentioned above, the electric powers of the heaters must be set to available maximum values. If do so, since the electric power of each heater will become 600 W to 700 W, rush current of each heater at the power supply start point becomes greater. To avoid this, as an example, combination of heaters each having low electric power is utilized. FIG. 7 shows a case where three heaters each having electric power of 400 W. In this case, as shown in FIG. 8, a large hysteresis temperature width is set for a heater (41), a small hysteresis temperature width is set for a heater (42), and a heater (43) is operated for a time period same as that of the heater (41). In this way, the symmetrical temperature distribution can be obtained. That is to say, the heater (41) is driven with the hysteresis width of 8° C. and then the heater (42) is driven with the hysteresis width of 2° C. Thereafter, the heater (43) is driven for the same time period as that of the heater (41).

However, the order of operating the heaters are not limited to the above. For example, the heaters may be operated or driven on the order of (41), (43), and (42). However, the timing of the operation of the heater (43) is set so that the heater (43) is operated when the temperature of the temperature detection element reaches the same power supply start temperature as that of the heater (41). While an example that the power supply start temperatures of the heaters (41) to (43) are set to be the same as each other was explained, it is desirable that dispersion between the power supply start temperatures of the heaters due to the heat generation of the heaters and set electric powers can be minimized.

Figure 9:
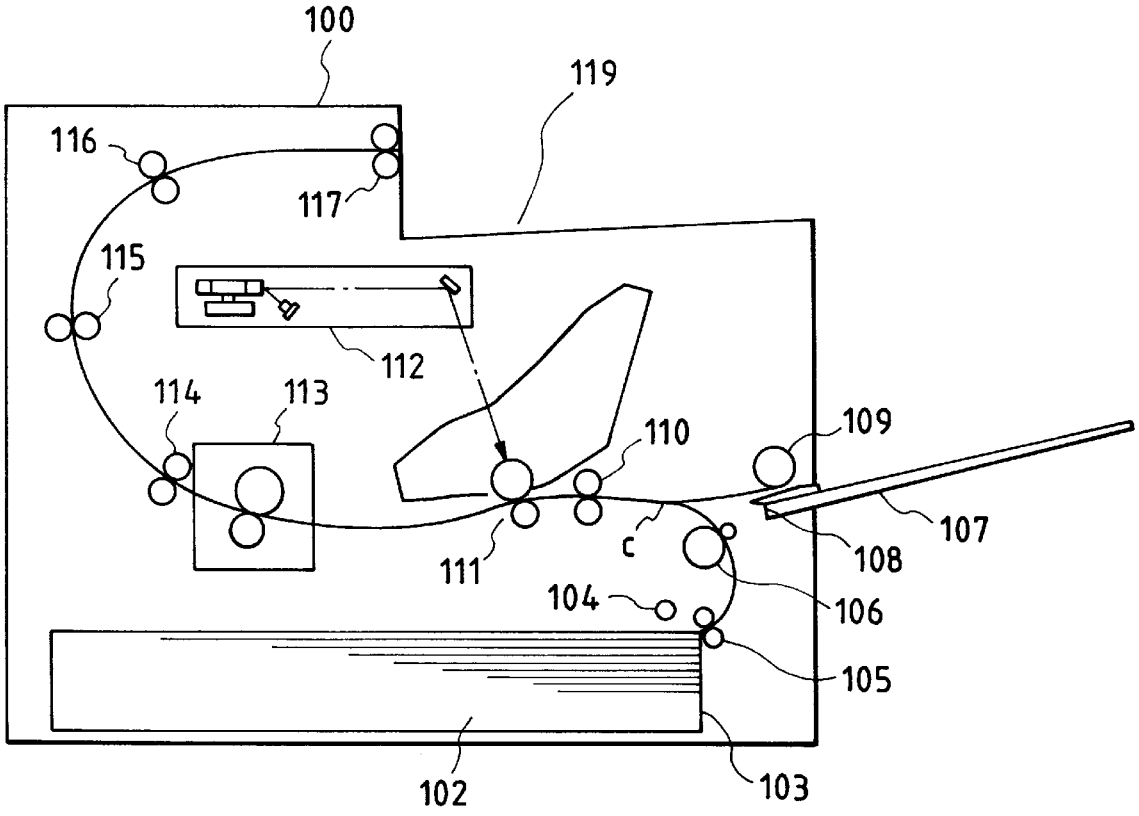
FIG. 9 is a schematic sectional view of a laser beam printer according to a fifth embodiment of the present invention.

FIG. 9 is a sectional view of a laser beam printer (an image forming apparatus) having a fixing heater control apparatus (image heating apparatus) according to a fifth embodiment of the present invention.

As shown in FIG. 9, the laser beam printer 100 includes a cassette 103 containing a plurality of recording sheets (transfer materials) 102 therein, and there are provided a pick-up roller 104 for picking up the recording sheet 102 from the cassette 103, and a pair of sheet supply rollers 105 for feeding the picked-up recording sheet. At a downstream side of the sheet supply rollers 105, there is disposed a convey roller 106 for conveying the recording sheet 102 to a pair of regist rollers 110 which will be described later.

The laser beam printer 100 includes a multi purpose tray (referred to as "MPT" hereinafter) 107 capable of manually inserting a recording sheet having non-fixed form, an MPT sheet supply roller 109 for feeding out the recording sheet from the MPT 107, and an MPT lifter 108 for urging the recording sheet stack rested on the MPT against the sheet supply roller 109. A cassette 103 intersects with a recording sheet convey path from the MPT lifter 108 at a junction C, and the recording sheet 102 is conveyed by the pair of regist rollers 110 disposed at a downstream side of the junction C, in synchronous with the image formation.

On the other hand, at a downstream side of the pair of regist rollers 110, there is disposed an image forming portion 111 where an image is formed on the basis of laser light emitted from a laser scanner portion 112. A fixing device 113 is disposed at a downstream side of the image forming portion 111, and pairs of FD convey rollers 115, 116 and 117 are disposed at a downstream side of the fixing device 113 so that, after the image was fixed to the recording sheet 102, the latter is conveyed to a pair of FD discharge rollers 118 by means of the rollers 115 to 117.

Figure 10:
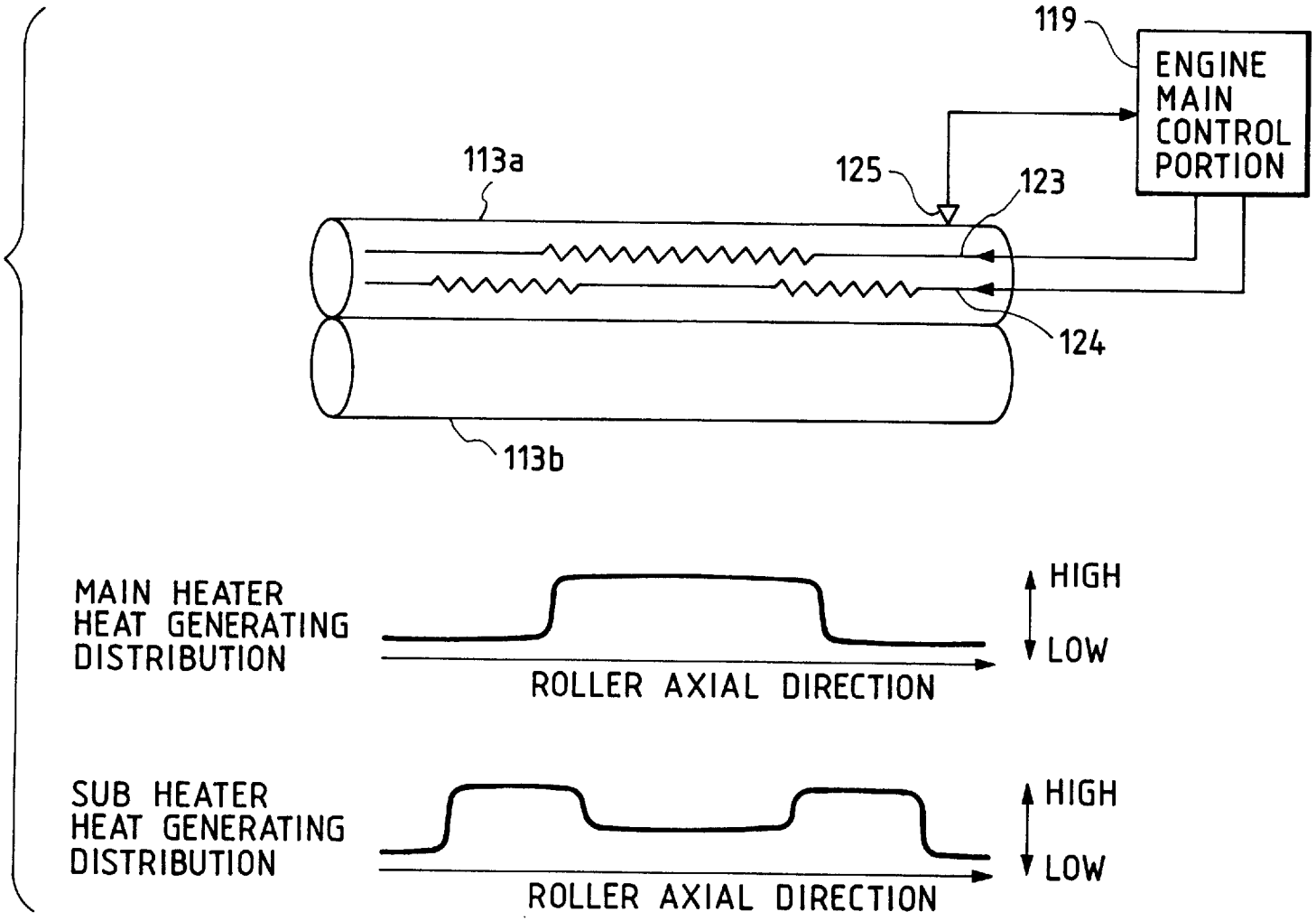
FIG. 10 is a conceptional view of a fixing device of the laser beam printer of FIG. 9.

FIG. 10 is an explanatory view showing a main construction of the fixing device 113. The fixing device according to this embodiment comprises a fixing roller (fixing member) 113*a* heated by a halogen heater (heater source) disposed within the fixing roller, a pressure roller 113*b* cooperating with the fixing roller 113*a* to form a nip therebetween, and a thermistor (temperature detection means) 125 for detecting a surface temperature of the fixing roller 113*a*. Two heaters having different heat generating distribution are disposed within the fixing roller 113*a*. One of the heaters is a main heater 123 having the main heat generating area disposed near the center of the fixing roller 113*a*, and the other heater is a sub heater 124 having the main heat generating areas near both ends of the fixing roller 113*a*. Further, since the thermistor 125 is contacted with the fixing roller 113*a*, the thermistor is disposed on a zone of the fixing roller 113*a* where the recording sheet 102 is not passed, in order to prevent the deterioration of the image due to friction at the contact portion. Thus, the thermistor 125 is positioned nearer the main heat generating area of the sub heater 124 (than that of the main heater).

Figure 11:
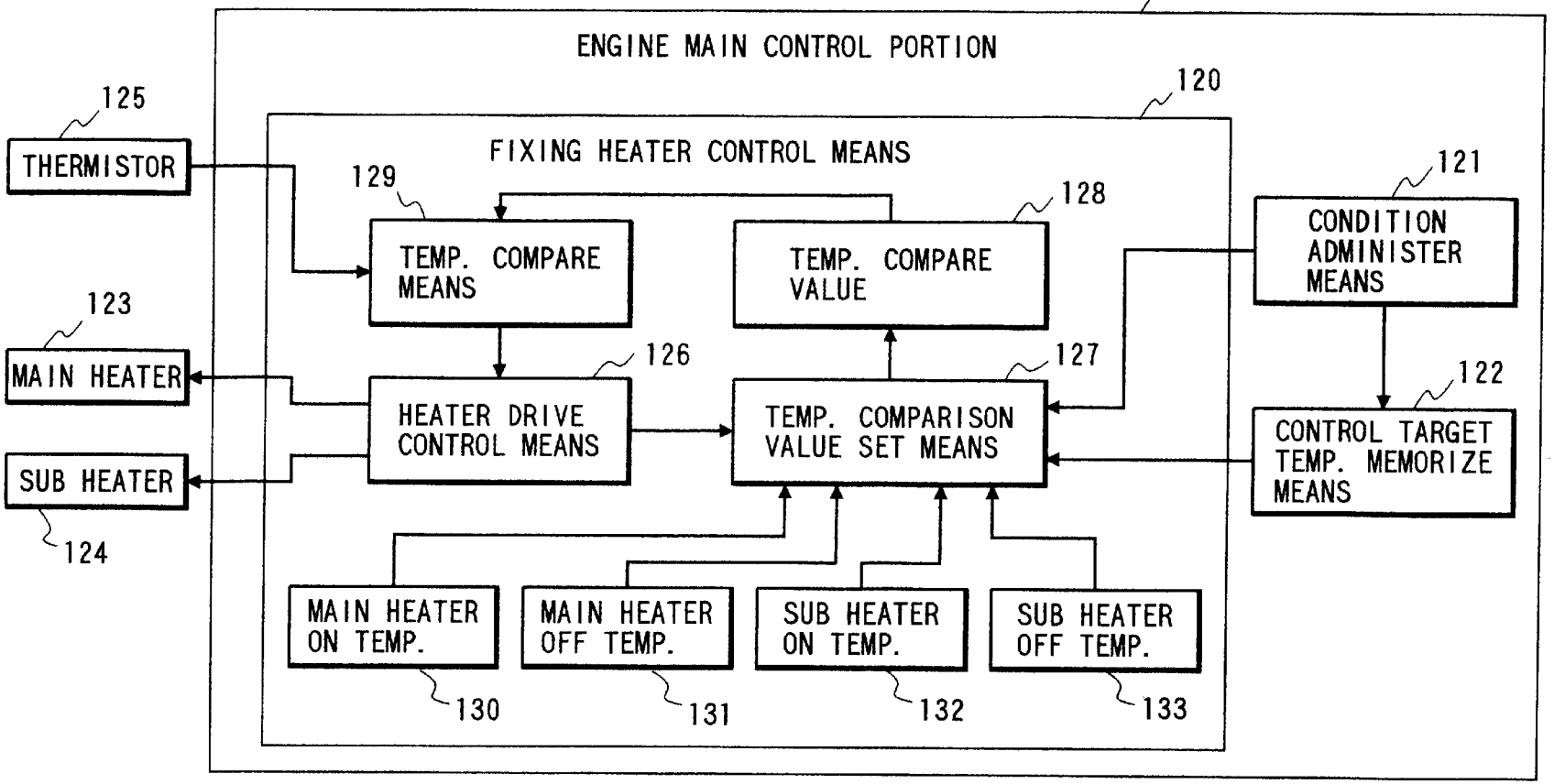
FIG. 11 is a block diagram of a fixing heater control portion according to the fifth embodiment.

FIG. 11 is a block diagram showing a fixing heater control apparatus according to the present invention. The laser beam printer 100 includes an engine main control portion 119 for controlling the entire engine, and the engine main control portion 119 includes a CPU, a ROM, a RAM and gate elements. The main control is performed by software stored in the ROM. The engine control portion 119 includes a fixing heater control means (power supply control means) 120, a condition administer means 121, and a control target temperature memorize means 122. The fixing heater control means includes a heater drive control means 126, a temperature comparison value set means 127, a temperature compare value 128, a temperature compare means 129, a main heater ON temperature 130, a main heater OFF temperature 131, a sub heater ON temperature 132, and a sub heater OFF temperature 133. Further, the thermistor 125 is connected to the engine main control portion 119 through an input circuit (not shown), and the main heater 123 and the sub heater 124 are connected to the engine main control portion through corresponding drivers (not shown).

Next, functions of various portions will be explained.

As mentioned above, the thermistor 125 serves to detect the surface temperature of the fixing roller 113*a*, and the detected temperature is inputted to the temperature compare means 129, where the detected temperature is compared with the temperature compare value 128 set by the temperature comparison value set means 127. On the basis of a compared result, the power supply to the main heater 123 and the sub heater 124 disposed within the fixing roller 113*a* is selectively controlled by the heater drive control means 126. In this way, the fixing roller 113*a* is heated.

Further, the condition administer means 121 serves to monitor various conditions including a warming-up condition, a stand-by condition, a print condition, a failure condition of the laser beam printer and the like, and, the condition administer means 121 sets the control target temperature on the basis of the monitored control conditions. The control target temperature is stored in the control target temperature memorize means 122. The control target temperature stored in the control target temperature memorize means 122 is read by the temperature comparison value set means 127, with the result that an ON temperature and an OFF temperature corresponding to it are selected on the basis of the main heater ON temperature 130, main heater OFF temperature 131, sub heater ON temperature 132 and sub heater OFF temperature 133. The selected ON and OFF temperatures are set as the temperature compare value 128.

By performing the fixing heater control as mentioned above, the temperature of the fixing roller 113*a* can be maintained to an optimum value in accordance with the conditions of the laser beam printer 100. However, in the temperature adjustment in a condition (stand-by condition) for waiting the print start after the warm-up treatment of the fixing device was finished, if two heaters are driven simultaneously or if the ON/OFF operations of the heaters are repeated frequently, fluorescent lamps connected to the same power source as the heaters may be flittered to cause a flicker phenomenon, and the service lives of the heaters may be shortened.

To avoid this, according to the illustrated embodiment, in the fixing heater control means 120, the main heater 123 and the sub heater 124 are driven alternately to reduce the rush current, and, a lower limit temperature for starting the driving of the heater and an upper limit temperature for stopping the driving of the heater are provided. And, by setting the lower limit temperature (i.e. heating start temperature) to a low value as small as possible and by setting the upper limit temperature (i.e. heating stop temperature) to a high value as great as possible, the number of ON/OFF operations of each heater is minimized, thereby increasing the service lives of the heaters.

In this case, the heater heating start temperature is previously set so that, when the print condition is started, the temperature of the heater can be increased to the target temperature (permitting the fixing of the image) within a predetermined time period, and the heater heating stop temperature is previously set so that, even when the print is started as it is, the fixing roller is not subjected to a dangerous condition or not damaged due to the temperature overshoot or the like.

Further, in the illustrated embodiment, the heater heating start temperatures and the heater heating stop temperatures are set independently regarding the main heater 123 and the sub heater 124 so that the difference between the actual heating amount and the detected temperature value caused due to the difference between the heat generating distributions of the heaters and the setting position of the thermistor is absorbed or eliminated. That is to say, by setting the main heater ON temperature (heater heating start temperature of the main heater 123) to a value same as or slightly greater than the sub heater ON temperature (heater heating start temperature of the sub heater 124) and by setting the main heater OFF temperature (heater heating stop temperature of the main heater 123) to a value smaller than the sub heater OFF temperature (heater heating stop temperature of the sub heater 124), the actual temperature change in the main heat generating area of the main heater 123 becomes substantially the same as the actual temperature change in the main heat generating areas of the sub heater 124. Further, even when the main heater 123 and the sub heater 124 are driven alternately, the heating times of these heaters can be substantially the same as each other, thereby making the service lives of the main heater 123 and the sub heater 124 uniform.

Figure 12:
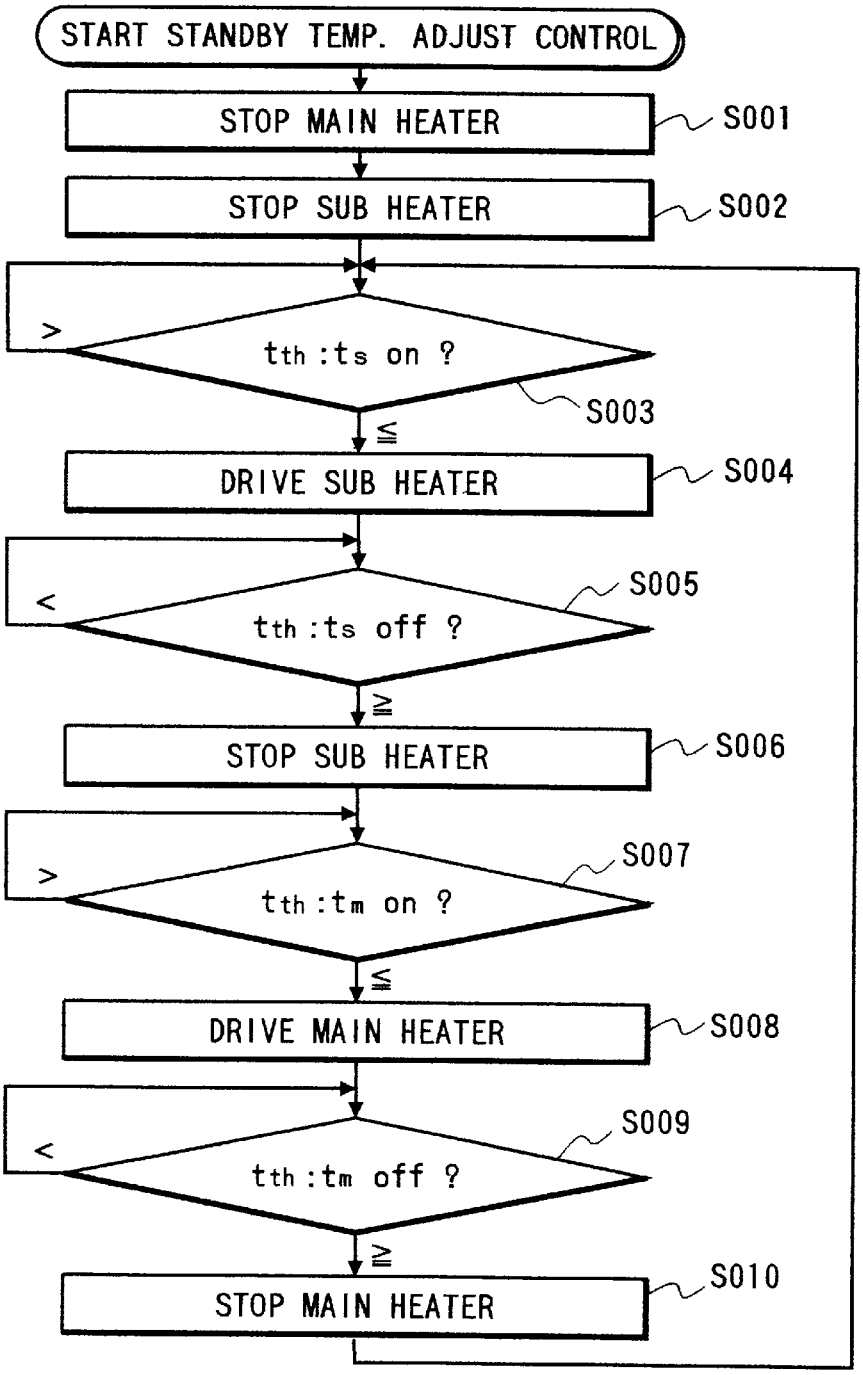
FIG. 12 is a flow chart showing the control of the fixing heater according to the fifth embodiment.

Now, the heater control in the stand-by condition of the fixing heater control means 120 will be explained with reference to a flow chart shown in FIG. 12.

First of all, after the power source of the printer is turned ON, when the warming-up of the fixing device is completed, the main heater 123 is stopped (step S001) and the sub heater 124 is stopped (step S002). Then, it is judged whether the detection temperature $t_{th}$ of the thermistor 125 is decreased below the heating start temperature $t_{s\ on}$ of the sub heater 124 (step S003). When the detection temperature $t_{th}$ is decreased below the heating start temperature $t_{s\ on}$ of the sub heater 124, the driving of the sub heater 124 is started (step S004), the driving of the sub heater 124 is continued until the detection temperature $t_{th}$ is increased above the heating stop temperature $t_{s\ off}$ of the sub heater 124 while comparing the detection temperature $t_{th}$ with the heating stop temperature $t_{s\ off}$ of the sub heater 124 (step S005). Thereafter, when the detection temperature $t_{th}$ is increased above the heating stop temperature $t_{s\ off}$ of the sub heater 124, the sub heater 124 is stopped (step S006). Then, it is judged whether the detection temperature $t_{th}$ is decreased below the heating start temperature $t_{m\ on}$ of the main heater 123 (step S007).

When the detection temperature $t_{th}$ is decreased below the heating start temperature $t_{m\ on}$ the main heater 123, the driving of the main heater 123 is started (step S008), and the driving of the main heater 123 is continued until the detection temperature $t_{th}$ is increased above the heating stop temperature $t_{m\ off}$ of the main heater 123 while comparing the detection temperature $t_{th}$ with the heating stop temperature $t_{m\ off}$ of the main heater 123 (step S009). As a result, when the detection temperature $t_{th}$ is increased above the heating stop temperature $t_{m\ off}$ of the main heater 123, the main heater 123 is stopped (step S010), and the program is returned to the heating start routine for the sub heater 124 (step S003). Then, the above-mentioned control is repeated.

In the illustrated embodiment, heaters each having rated voltage of 120 V and rated output of 500 W and having heat generating distribution as shown in FIG. 10 are used as the main heater 123 and the sub heater 124, and, when the control target temperature in the stand-by condition is 169° C., the main heater ON temperature is set to 169° C., the main heater OFF temperature is set to 171° C., the sub heater ON temperature is set to 169° C., and the sub heater OFF temperature is set to 177° C.

By setting the temperatures in this way, in the stand-by condition, even when the main heater 123 and the sub heater 124 are driven alternately, the heating times of the heaters become the same as each other, and the temperature of the fixing roller 113*a* can be maintained to the control target temperature of 169° C. Further, by properly selecting the difference between the ON temperature and the OFF temperature of each heater, the number of heating operations of the heater can be greatly reduced in comparison with the conventional techniques.

Next, a sixth embodiment of the present invention will be explained with reference to FIGS. 13 and 14. In the fifth embodiment, while an example that, after one of the heaters is driven, the driving of heater is continued until the detection temperature reaches the heating stop temperature and the other heater is stopped was explained, in the sixth embodiment, when a predetermined time period is elapsed after one of the heaters was driven, the heating of heater is finished and at the same time the heating of the other heater is started so that the surface temperature of the fixing roller becomes more uniform, thereby making the heating time periods of the heaters substantially the same as each other.

Now, the sixth embodiment will be explained regarding a laser beam printer as an example. Since the construction of the laser beam printer according to this embodiment is the same as that shown in FIG. 9 and the main construction of the fixing device 113 is the same as that shown in FIG. 10, detailed explanations thereof will be omitted.

Figure 13:
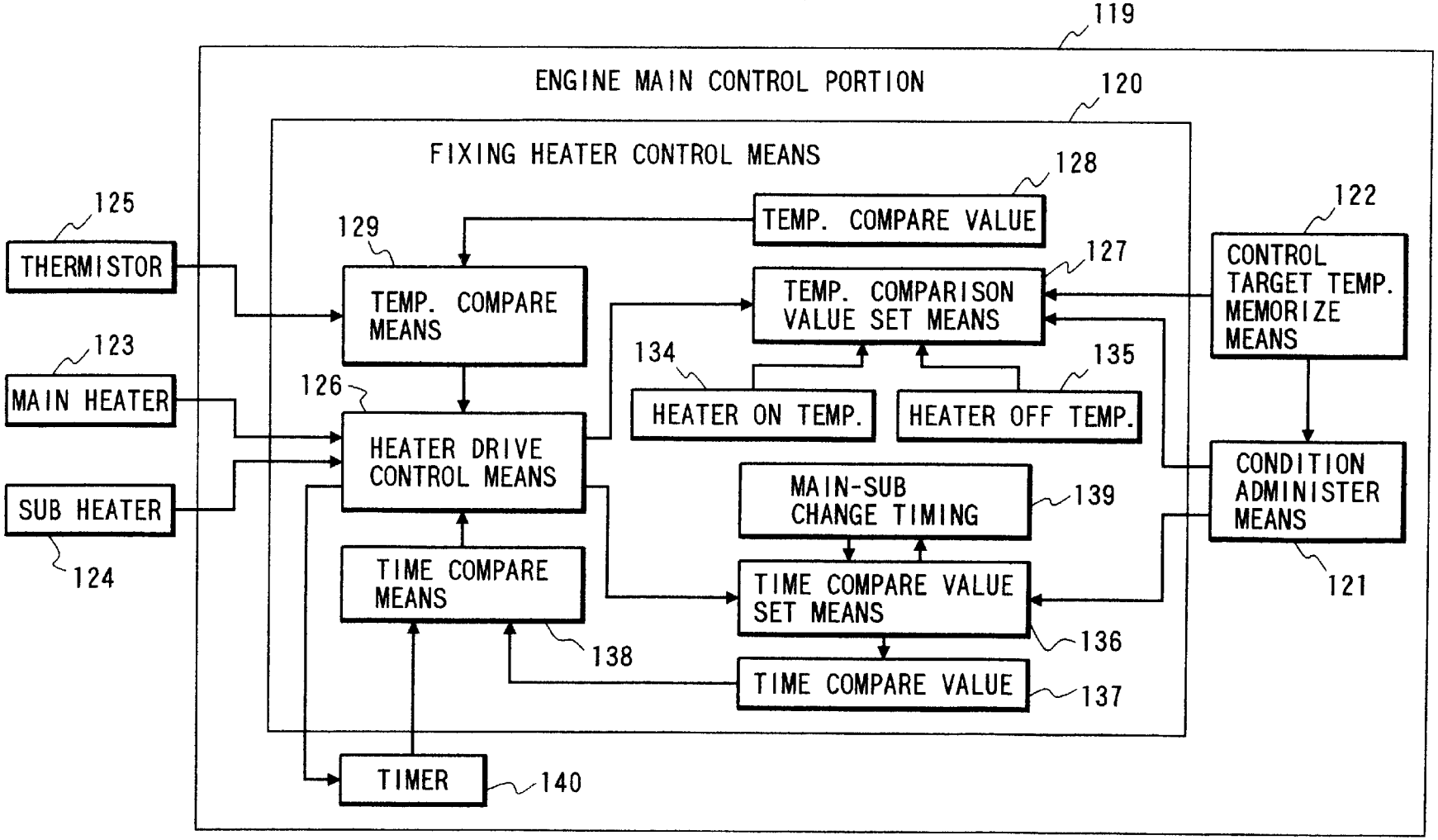
FIG. 13 is a block diagram of a fixing heater control portion according to a sixth embodiment of the present invention.

FIG. 13 is a block diagram showing the sixth embodiment. In FIG. 13, although an engine control portion 119, a fixing heater control means 120, a condition administer means 121, a control target temperature memorize means 122, a main heater 123, a sub heater 124, a thermistor 125, a heater drive control means 126, a temperature comparison value set means 127, a temperature compare value 128, a temperature compare means 129 are the same as those in the fifth embodiment, ON/OFF temperature values for the main and sub heaters 123, 124. Alternatively, there are provided a common heater ON temperature 134 and a common heater OFF temperature 135. Further, in order to control the heating time of the sub heater, there are provided a time compare value set means 136, a time compare value 137, a time compare means 138 and a sub heater heating time 139. In addition, there is provided a timer (power supply time measuring means to the heaters) 140. When the stand-by condition is achieved, the time compare value set means 136 sets the value of the sub heater heating time 139 as the time compare value 137. The time compare means 138 sends a comparison result between the count value of the timer 140 and the time compare value 137 to the heater drive control means 126. The timer 140 counts the time on the basis of the command from the heater drive control means 126.

Figure 14:
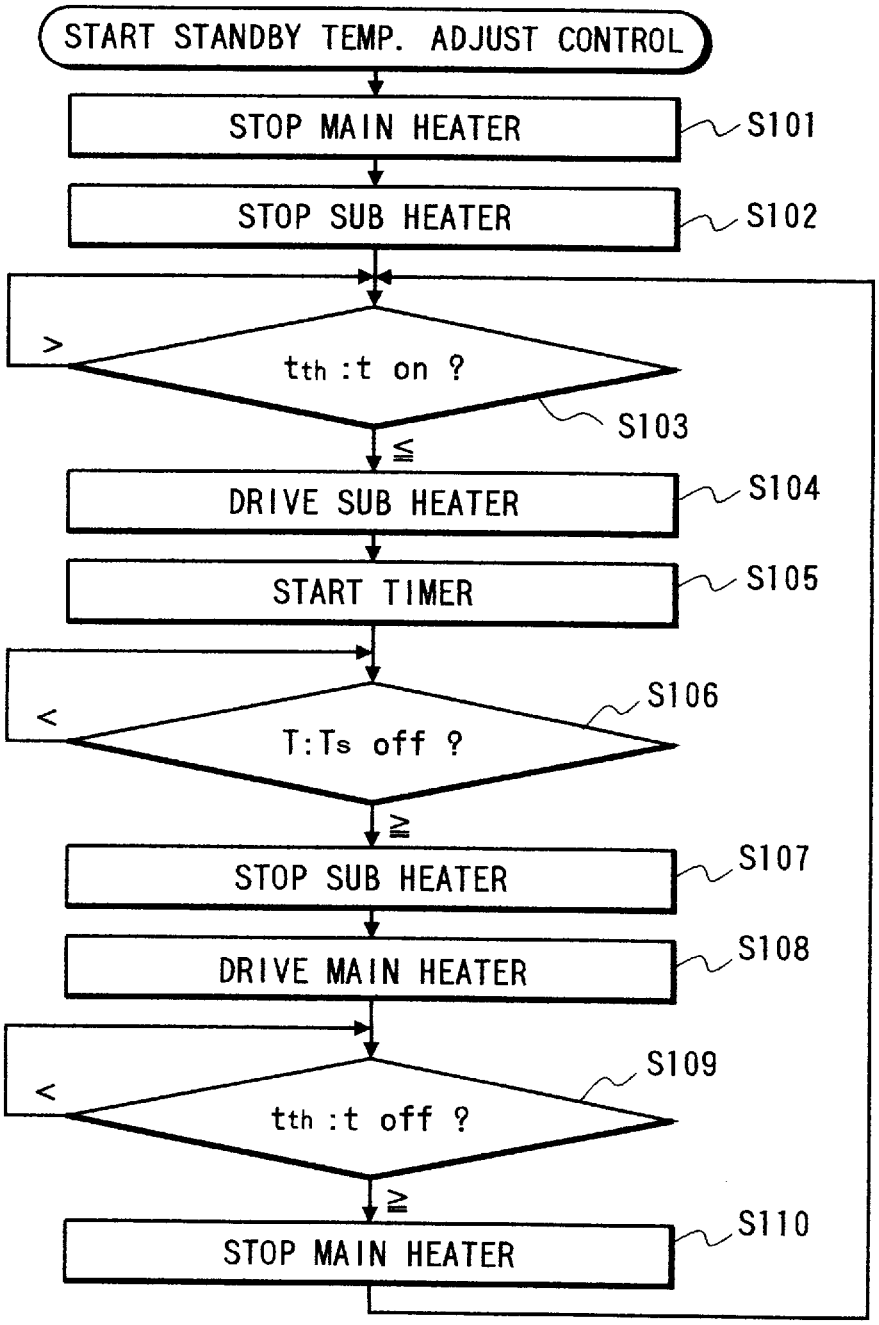
FIG. 14 is a flow chart showing the control of the fixing heater according to the sixth embodiment.

FIG. 14 shows a flow chart regarding the control of the fixing heater control means in the stand-by condition.

First of all, when the warming-up of the fixing device is completed, the main heater 123 is stopped (step S101) and the sub heater 124 is stopped (step S102). Then, it is judged whether the detection temperature $t_{th}$ is decreased below the heater heating start temperature $t_{on}$ (step S103). When the detection temperature $t_{th}$ is decreased below the heater heating start temperature $t_{on}$ the driving of the sub heater 124 is started (step S104), and the timer 140 is started (step S105). The driving of the sub heater 124 is continued until the timer count value T reaches the sub/main change timing (sub heater heating time) $t_{s\ off}$ set to the time compare value 137 (step S106).

Thereafter, when the sub/main change timing is reached, the sub heater 124 is stopped (step S107). Then, the driving of the main heater 123 is started (step S108), and the driving of the main heater 123 is continued until the detection temperature $t_{th}$ is increased above the heater heating stop temperature $t_{off}$ while comparing the detection temperature $t_{th}$ with the heater heating stop temperature $t_{off}$ (steps S108 and S109). When the detection temperature $t_{th}$ is increased above the heater heating stop temperature $t_{off}$, the main heater 123 is stopped (step S110), and the program is returned to the heating start routine for the sub heater 124 (step S103). Then, the above-mentioned control is repeated.

By effecting the temperature adjustment of the fixing roller in the stand-by condition as mentioned above, even when the power supply start temperature and the power supply stop temperature are set in common regarding the main heater and the sub heater, the power supply times to the main and sub heaters can be made the same as each other.

Next, a seventh embodiment of the present invention will be explained with reference to FIGS. 15 to 17. Incidentally, the same elements as those in the fifth embodiment are designated by the same reference numerals, and explanation thereof will be omitted.

In the sixth embodiment, while an example that the drive change timings of the sub heater and the main heater are set to the predetermined fixed values (for example, the main heater is driven after the power supply to the sub heater is effected for the predetermined time period) was explained. In the seventh embodiment, by adjusting the change timing between the sub heater and the main heater by measuring the heating time (period) of the main heater, the heating times of the main heater and the sub heater can be made substantially the same as each other.

Figure 15:
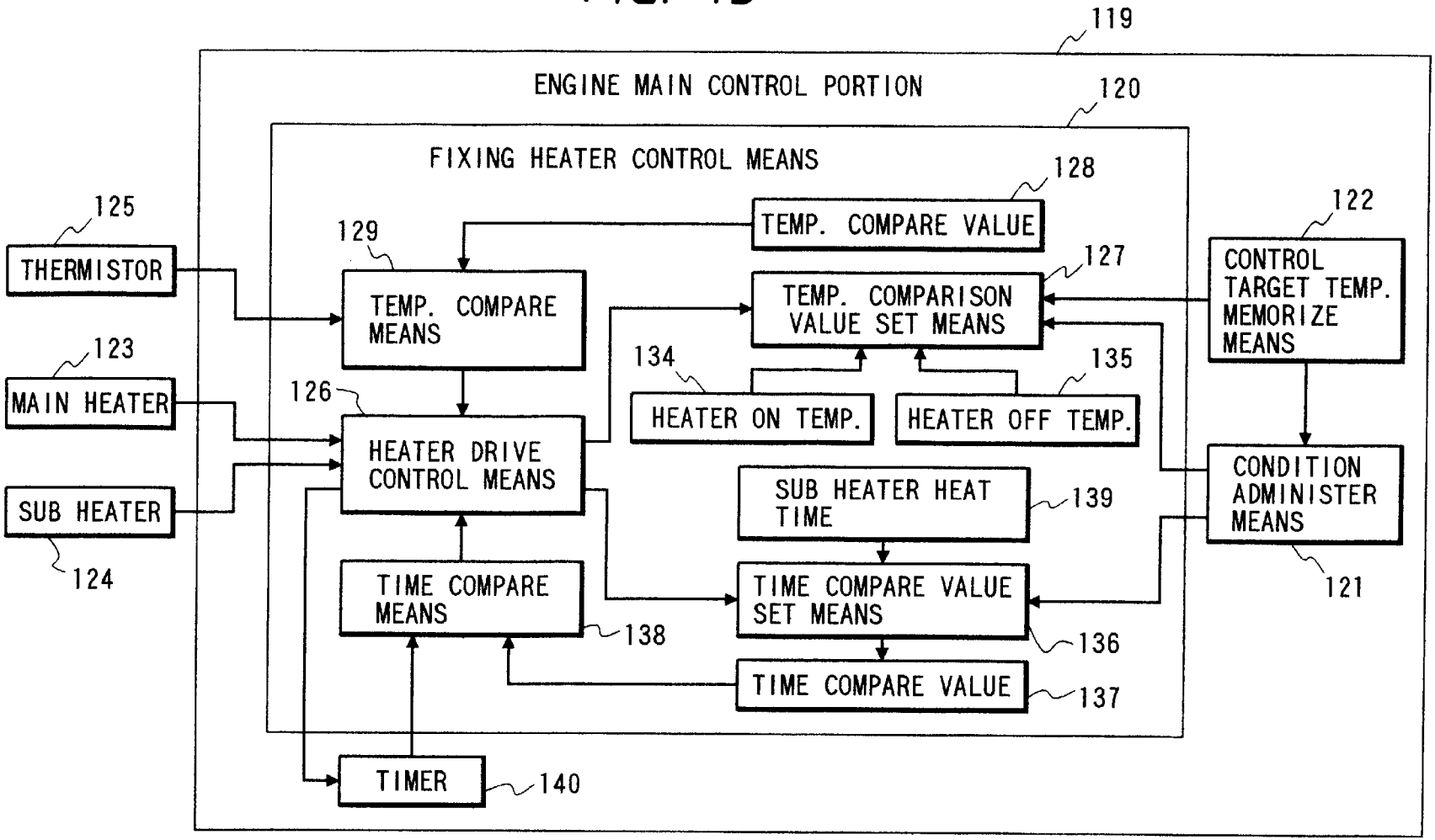
FIG. 15 is a block diagram of a fixing heater control portion according to a seventh embodiment of the present invention.

FIG. 15 is a block diagram showing the seventh embodiment. In this seventh embodiment, although the construction of the engine main control portion is the same as that of the sixth embodiment, the heater drive control means 126 serves to start the timer both when the driving of the sub heater is started and when the driving of the main heater is started, and the time compare value set means 136 serves to compare the heating time of the sub heater 124 and the heating time of the main heater 123 and to adjust the set value of the time compare value 137 so that the heating timers of the sub and main heaters become substantially the same as each other.

Figure 16:
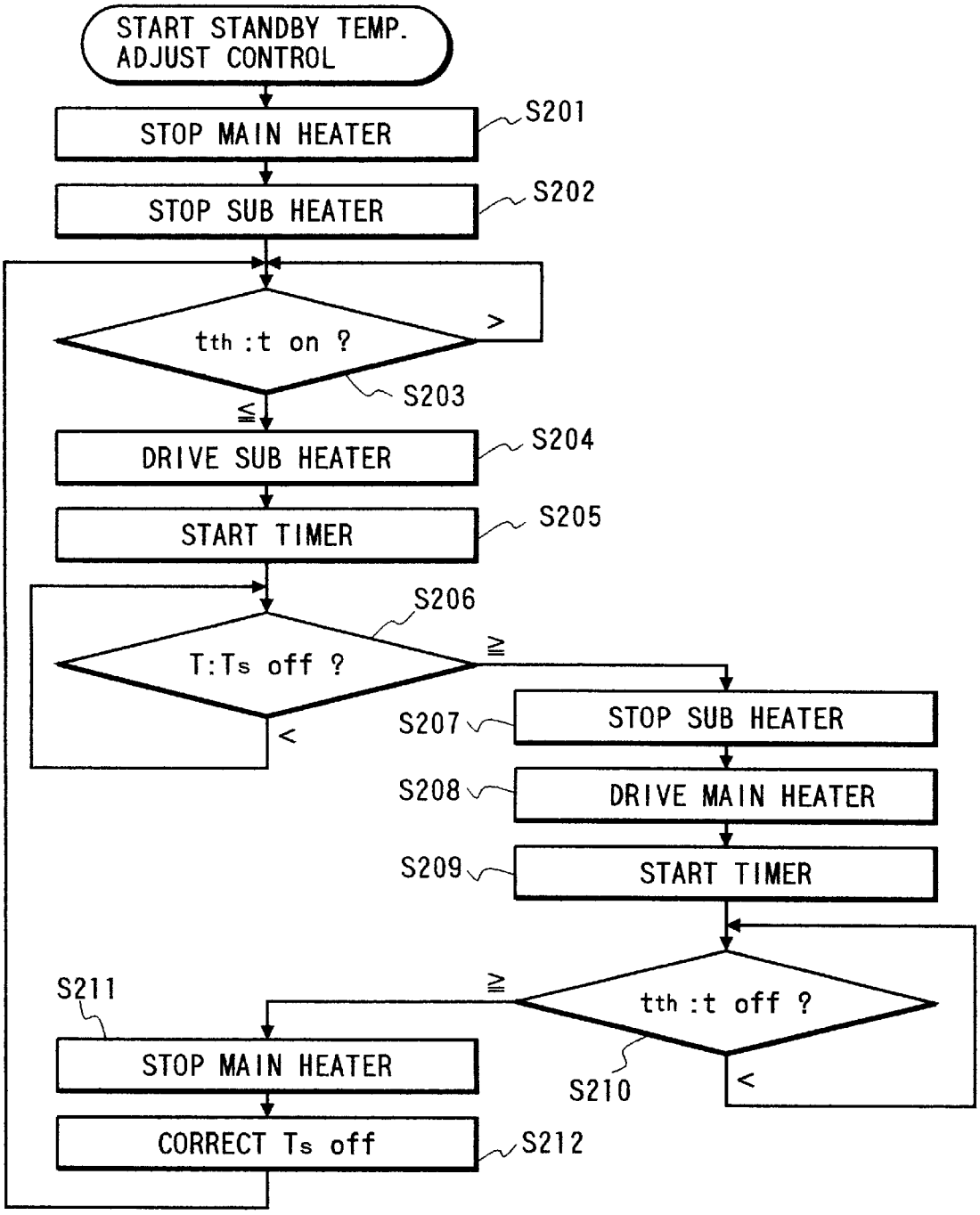
FIG. 16 is a flow chart showing the control of the fixing heater according to the seventh embodiment.

FIG. 16 shows a flow chart regarding the control of the fixing heater control means in the stand-by condition.

First of all, when the warming-up of the fixing device is completed, the main heater 123 is stopped (step S201) and the sub heater 124 is stopped (step S202). Then, it is judged whether the detection temperature $t_{th}$ is decreased below the heater heating start temperature $t_{on}$ (step S203). When the detection temperature $t_{th}$ is decreased below the heater heating start temperature $t_{on}$, the driving of the sub heater 124 is started (step S204), and the timer 140 is started (step S205). The driving of the sub heater 124 is continued until the timer count value T reaches the sub/main change timing (sub heater heating time) $t_{s\ off}$ set to the time compare value 137 (step S206). When the sub/main change timing is reached, the sub heater 124 is stopped (step S207), and then the driving of the main heater 123 is started (step S208).

Thereafter, the timer 140 is re-started (step S209), and the driving of the main heater 123 is continued until the detection temperature $t_{th}$ is increased above the heater heating stop temperature $t_{off}$ while comparing the detection temperature $t_{th}$ with the heater heating stop temperature $t_{off}$ (step S210). When the detection temperature $t_{th}$ is increased above the heater heating stop temperature $t_{off}$, the main heater 123 is stopped (step S211), and then, the value of $T_{s\ off}$ is corrected in accordance with the following equation (1) on the basis of the timer count value (main heater heating time) T at that time (step S212):

$$T_{s\ off}=(T_{s\ off}+T)/2 \quad (1)$$

Figure 17:
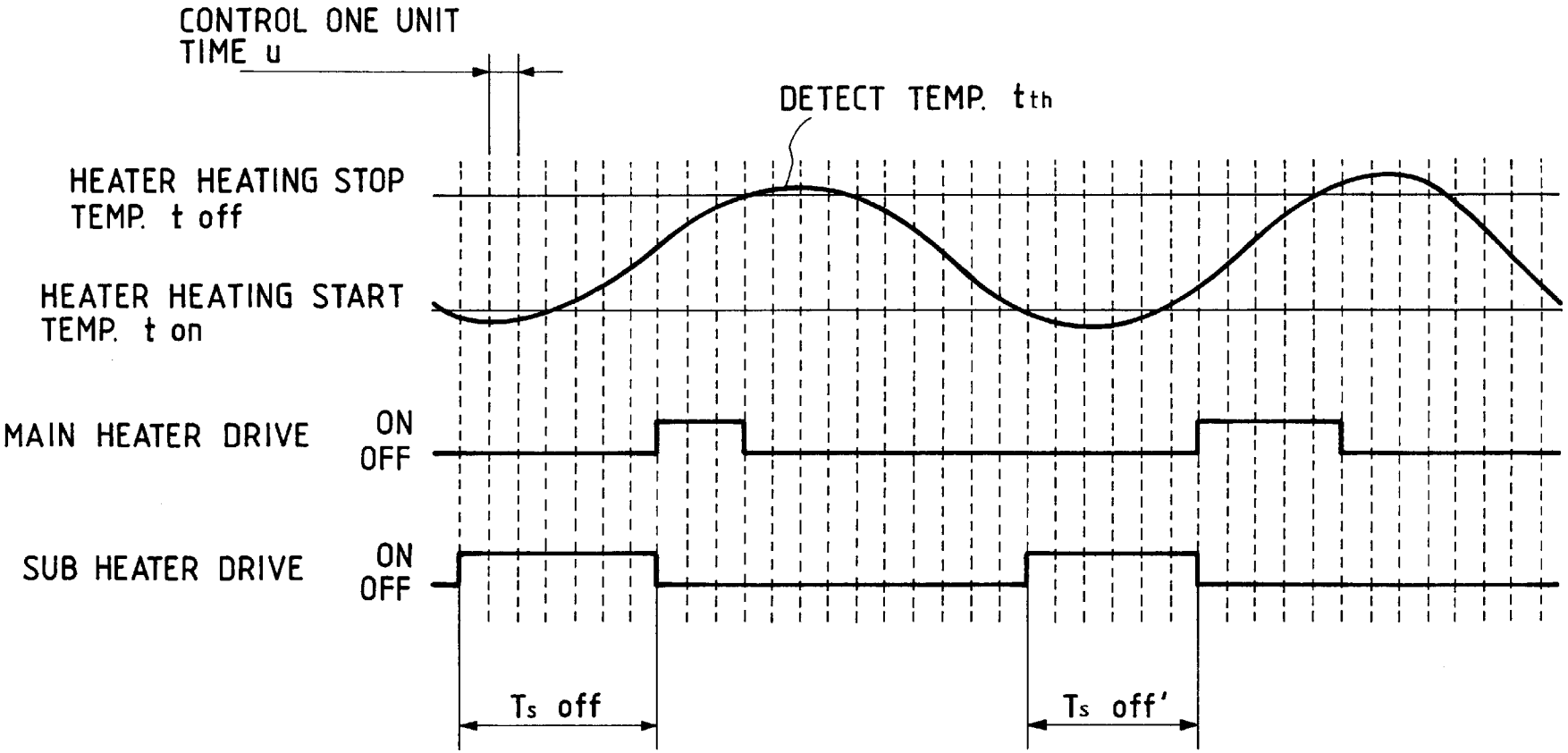
FIG. 17 is a timing chart schematically showing the control of the fixing heater according to the seventh embodiment.

The temperature difference and the heater drive timing when the temperature adjustment is effected in this way in the stand-by condition is shown in FIG. 17. In FIG. 17, "u" denotes one unit time of heater control, i.e. control cycle. As shown, by correcting the previously set $T_{s\ off}$ value on the basis of the main heater heating time, in the next heating, the heating time of the main heater and the heating time of the sub heater can be approached to each other. By effecting the temperature adjustment of the fixing roller in the stand-by condition as mentioned above, the power supply times to the main and sub heaters can be made the same as each other, thereby preventing the unbalance between the service lives of the heaters.

Figure 18:
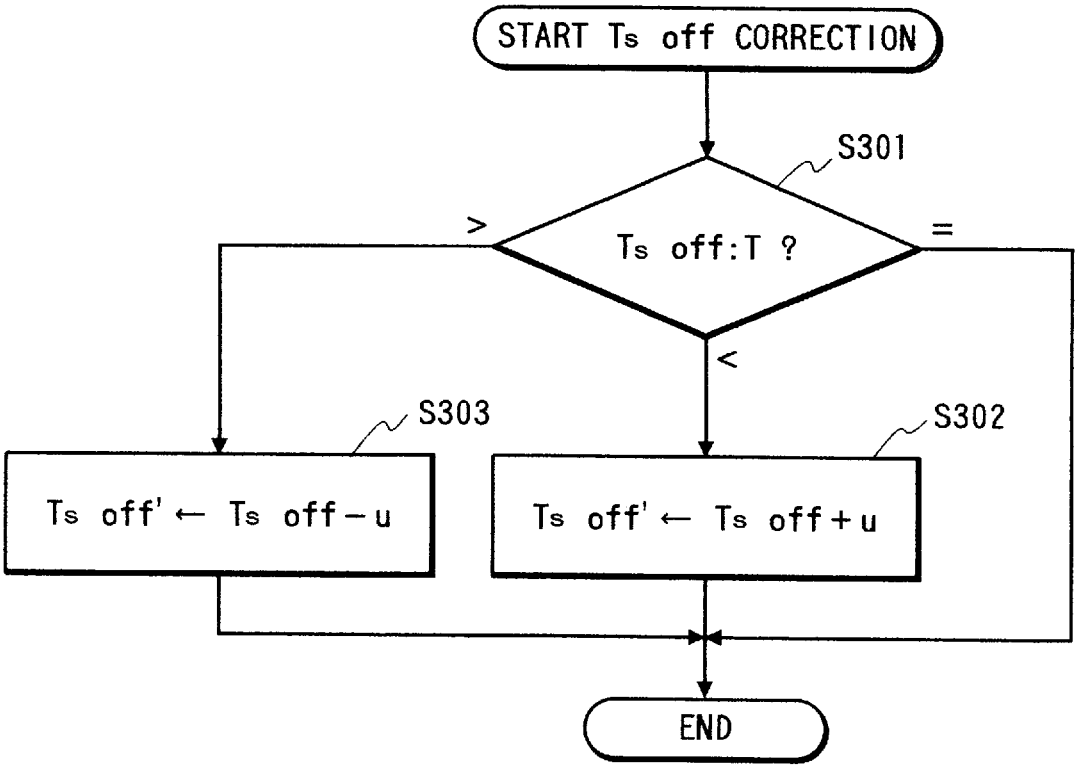
FIG. 18 is a flow chart showing a method for correcting a heater change timing, according to an eighth embodiment of the present invention.

Next, an eighth embodiment of the present invention will be explained with reference to FIG. 18. Incidentally, the same elements as those in the fifth embodiment are designated by the same reference numerals, and explanation thereof will be omitted.

In the seventh embodiment, while an example that the change timing $T_{s\ off}$ between the driving of the sub heater and the driving of the main heater is determined by the equation (1) was explained, in this eighth embodiment, the change timing $T_{s\ off}$ is increased or decreased by a predetermined time on the basis of the comparison result between that heating times of the main and sub heaters. Although the construction and the control content are substantially the same as those of the seventh embodiment, in the eighth embodiment, the treatment for correcting the value $T_{s\ off}$ in FIG. 16 (step S212) is effected as shown in FIG. 18 (not by using the equation (1)).

First of all, the heating time $T_{s\ off}$ of the sub heater 124 is compared with the later timer count value T (i.e. the heating time of the main heater 123)(step S301). If the heating time T of the main heater 123 is greater than the heating time $T_{s\ off}$ of the sub heater 124, the value $T_{s\ off}$ is increased by one unit time u (step S302); whereas, if the heating time $T_{s\ off}$ of the sub heater 124 is greater than the heating time T of the main heater 123, the value $T_{s\ off}$ is decreased by one unit time u (step S303). If the $T_{s\ off}$ is the same as T, the value $T_{s\ off}$ is unchanged.

Next, a ninth embodiment of the present invention will be explained with reference to FIGS. 19 and 20. Incidentally, the same elements as those in the fifth embodiment are designated by the same reference numerals, and explanation thereof will be omitted.

In the sixth embodiment, while an example that the change between the driving of the sub heater and the driving of the main heater is controlled by "time" was explained, in the ninth embodiment, such change is controlled on the basis of the detection temperature detected by the thermistor.

Figure 19:
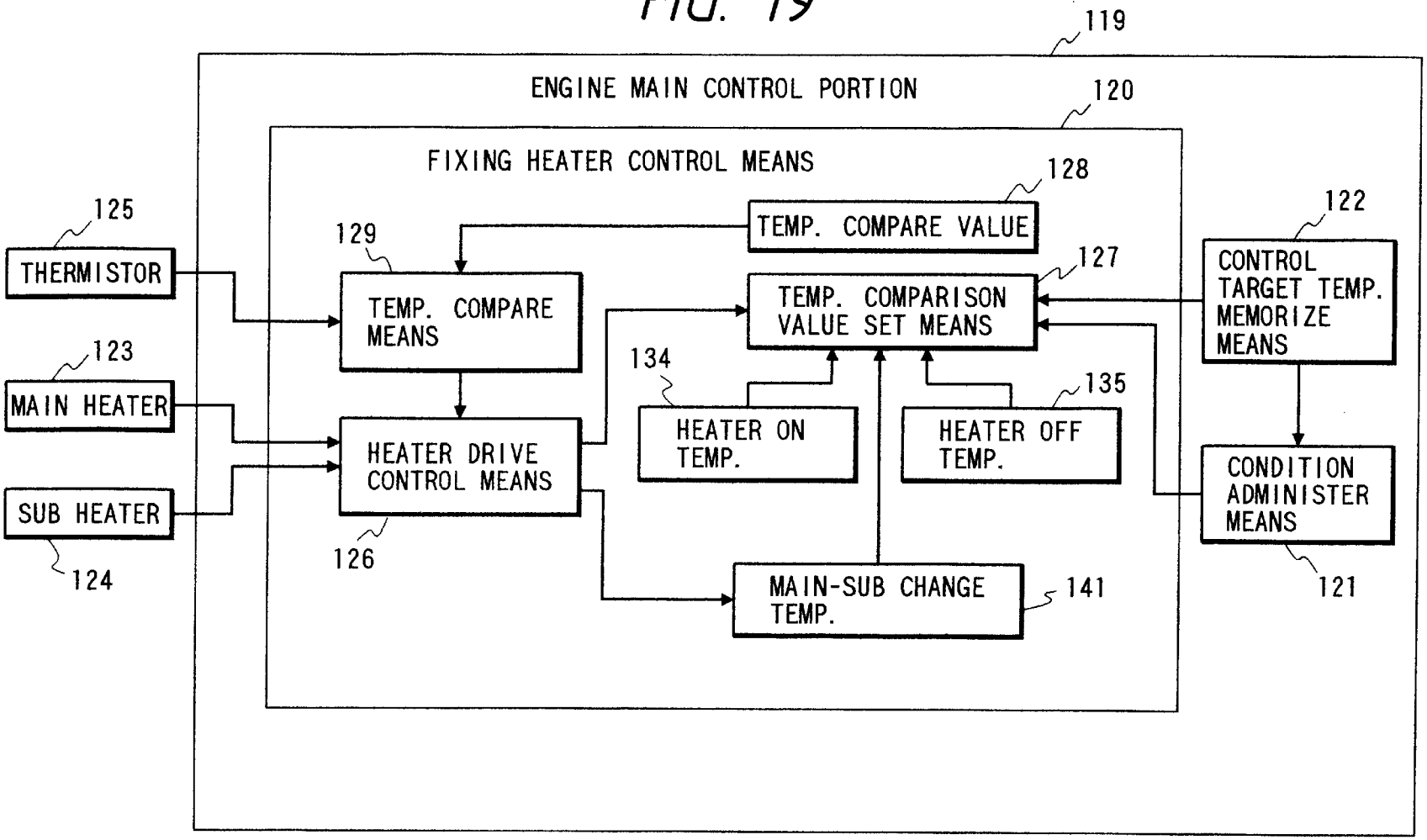
FIG. 19 is a block diagram of a fixing heater control portion according to a ninth embodiment of the present invention.

FIG. 19 is a block diagram showing the ninth embodiment. Although the construction of the engine main control portion according to this embodiment is substantially the same as that in the sixth embodiment, there are no time compare value set means 136, time compare value 137, time compare means 138 and timer 140 of the sixth embodiment, and, in place of the sub heater heating timing 139, there is provided a main/sub change time 141. When the driving of the sub heater is started by the heater drive means 129, the temperature compare value set means 127 sets the main/sub change temperature value as the temperature compare value 128. By doing so, when the detection temperature reaches the sub/main change temperature, the driving of the sub heater is changed to the driving of the main heater by means of the heater drive control means 126.

Figure 20:
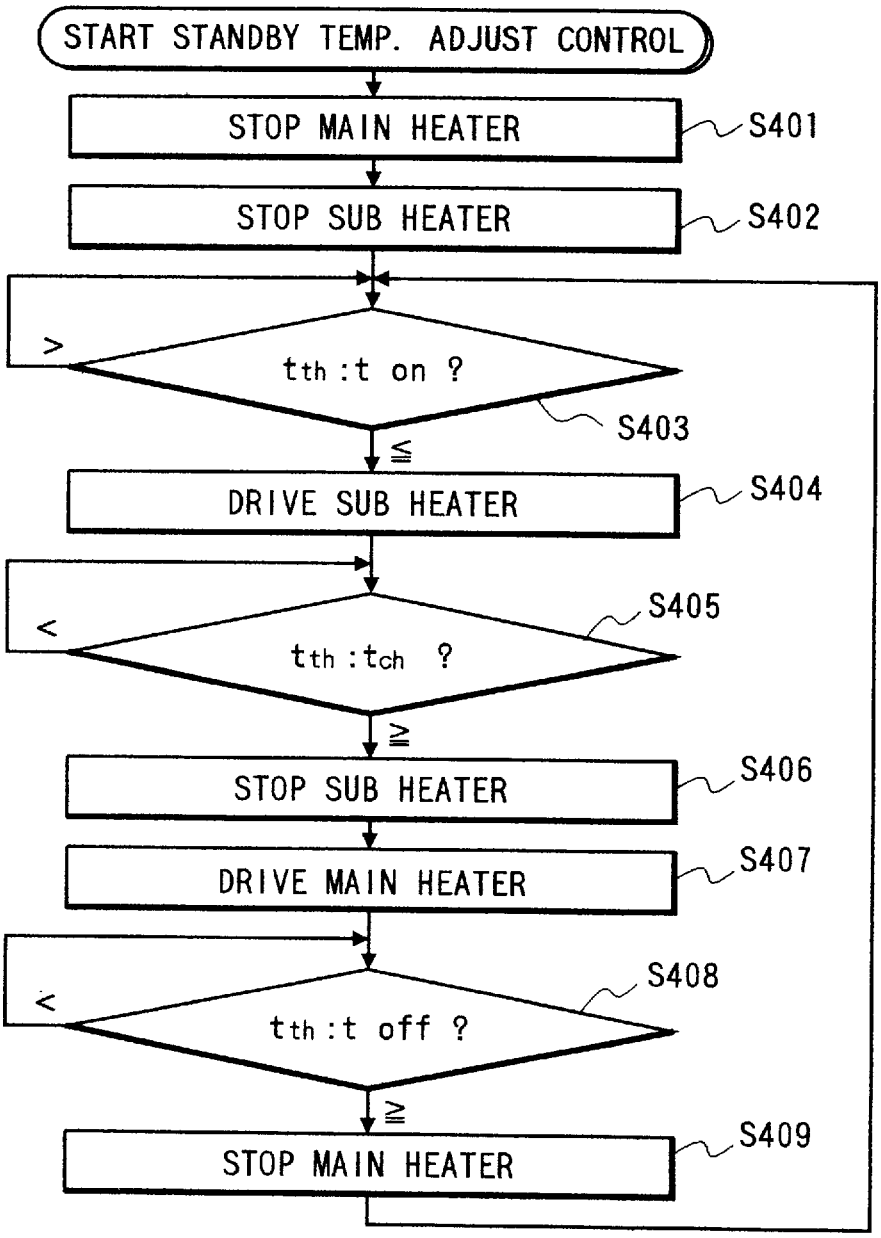
FIG. 20 is a flow chart showing the control of the fixing heater according to the ninth embodiment.

FIG. 20 shows a flow chart regarding the control of the fixing heater control means in the stand-by condition.

First of all, when the warming-up of the fixing device is completed, the main heater 123 is stopped (step S401) and the sub heater 124 is stopped (step S402). Then, it is judged whether the detection temperature $t_{th}$ is decreased below the heater heating start temperature $t_{on}$ (step S403). When the detection temperature $t_{th}$ is decreased below the heater heating start temperature $t_{on}$, the driving of the sub heater 124 is started (step S404), and the driving of the sub heater 124 is continued until the detection temperature $t_{th}$ is increased above the change temperature $t_{ch}$ (step S405). When the detection temperature $t_{th}$ is increased above the change temperature $t_{ch}$, the sub heater 124 is stopped (step S406), and then the driving of the main heater 123 is started (step S407).

Thereafter, the driving of the main heater is continued until the detection temperature $t_{th}$ is increased above the heater heating stop temperature $t_{off}$ while comparing the detection temperature $t_{th}$ with the heater heating stop temperature $t_{off}$ (step S408). When the detection temperature $t_{th}$ is increased above the heater heating stop temperature $t_{off}$, the main heater 123 is stopped (step S409), and the program is returned to the heating start routine for the sub heater 124 (step S403). Then, the above-mentioned control is repeated.

By effecting the temperature adjustment of the fixing roller in this way in the stand-by condition, the same technical advantage as the sixth embodiment can be obtained.

Next, a tenth embodiment of the present invention will be explained with reference to FIGS. 21 to 23. Incidentally, the same elements as those in the fifth embodiment are designated by the same reference numerals, and explanation thereof will be omitted. In the ninth embodiment, while an example that the drive change temperatures of the sub heater and the main heater are set to the predetermined fixed values was explained, in the tenth embodiment, by adjusting the change timing between the sub heater and the main heater by measuring the heating time (period) of the main heater, the heating times of the main heater and the sub heater can be made substantially the same as each other.

Figure 21:
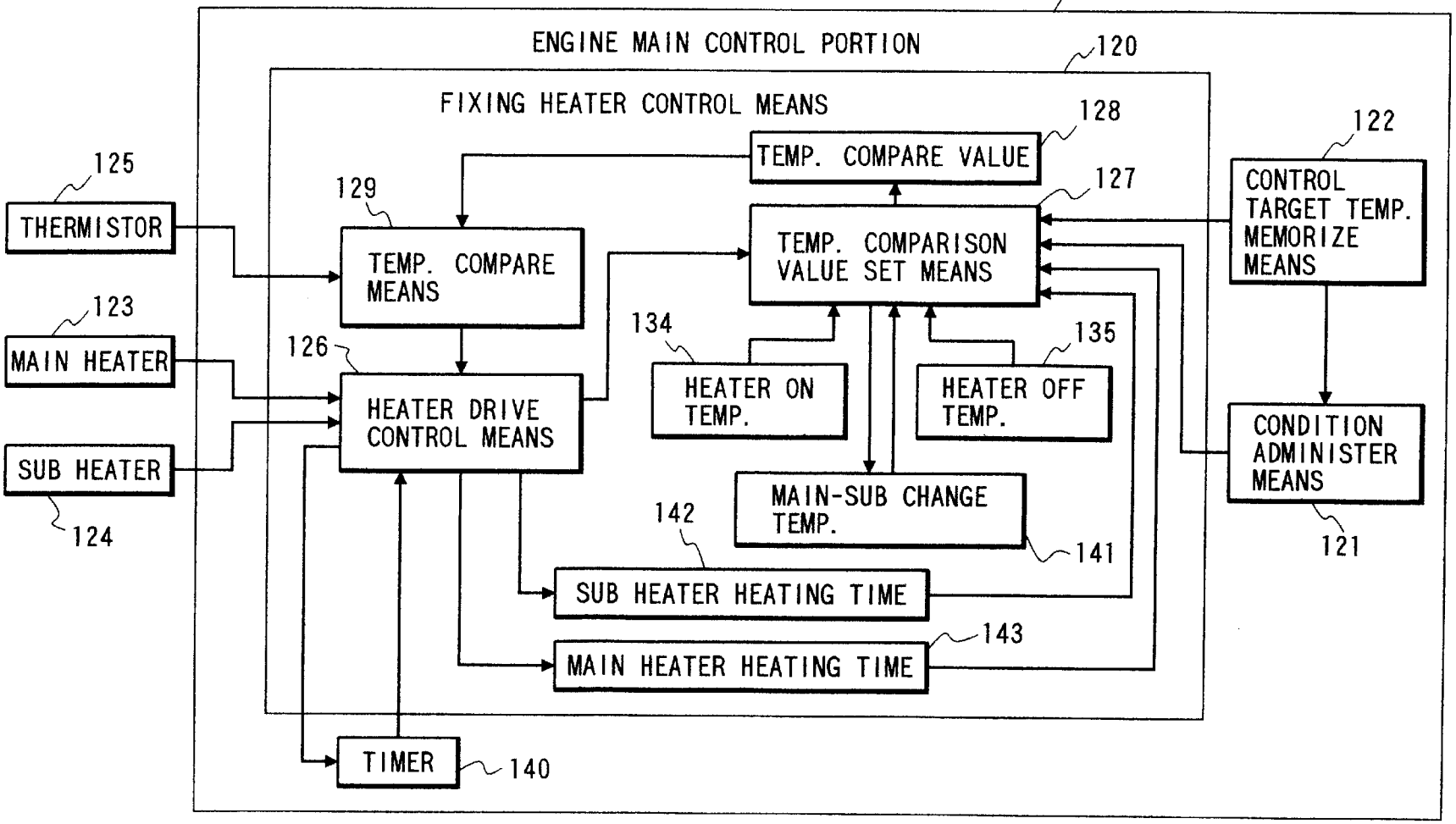
FIG. 21 is a block diagram of a fixing heater control portion according to a tenth embodiment of the present invention.

FIG. 21 is a block diagram showing the tenth embodiment. In this tenth embodiment, in addition to the circuit (shown in FIG. 19) regarding the ninth embodiment, there are provided a timer 140 for measuring the heater heating times, a heater heating time storing area 142 for the main heater, and a heater heating time storing area 143 for the sub heater. The heater drive control means 126 serves to start the timer both when the driving of the sub heater is started and when the heating of the main heater is started, and the timer count values are stored in the heater heating time storing areas 142, 143 when the heating operations of the sub and main heaters are stopped, respectively. The temperature compare value set means 127 serves to compare the heating time of the sub heater 124 and the heating time of the main heater 123, thereby adjusting the set temperature compare value 128 to make both heating times substantially the same as each other.

Figure 22:
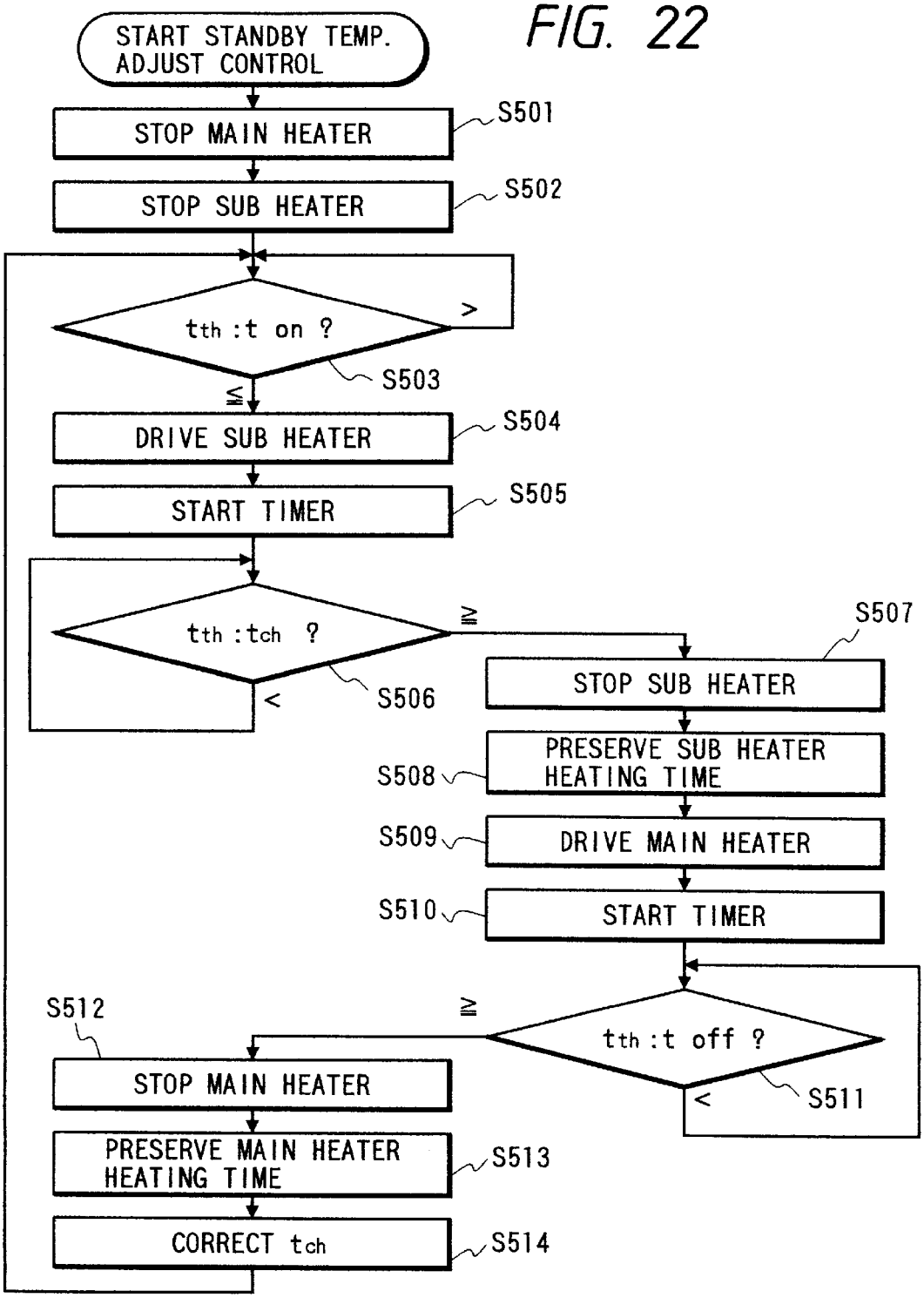
FIG. 22 is a flow chart showing the control of the fixing heater according to the tenth embodiment.
Figure 23:
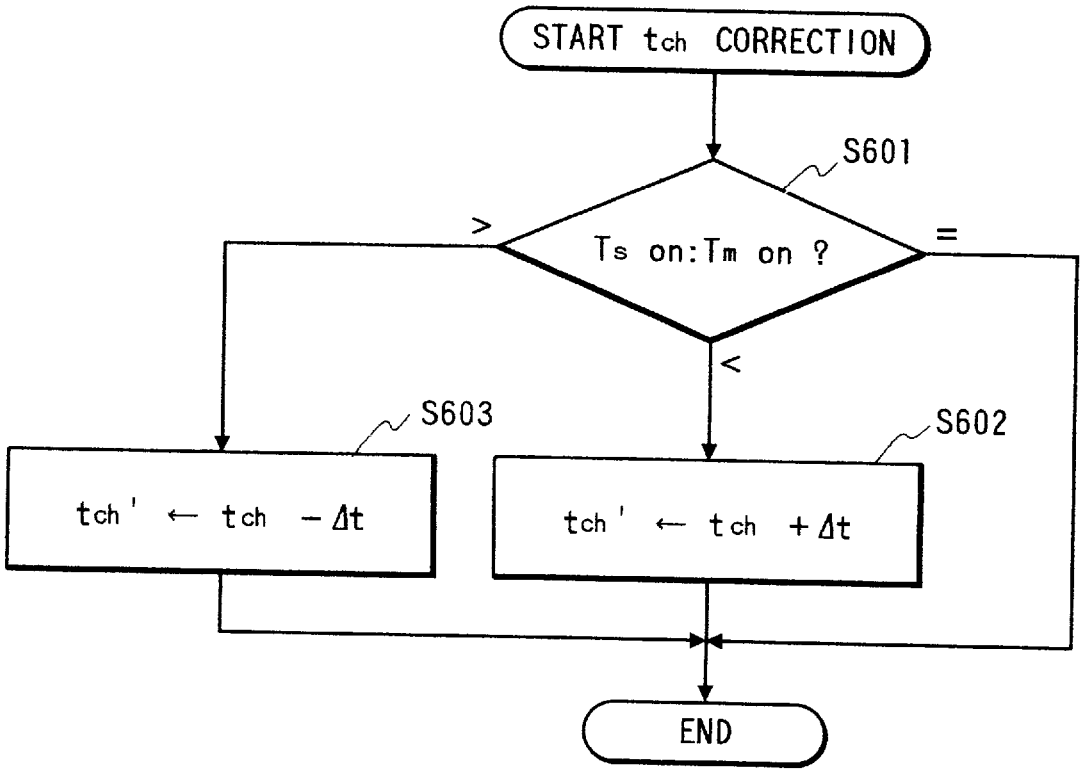
FIG. 23 is a flow chart showing a method for correcting a heater change timing, according to the tenth embodiment.

FIG. 22 shows a flow chart regarding the control of the fixing heater control means in the stand-by condition.

First of all, when the warming-up of the fixing device is completed, the main heater 123 is stopped (step S501) and the sub heater 124 is stopped (step S502). Then, it is judged whether the detection temperature $t_{th}$ is decreased below the heater heating start temperature $t_{on}$ (step S503). When the detection temperature $t_{th}$ is decreased below the heater heating start temperature $t_{on}$, the driving of the sub heater 124 is started (step S504), and the timer 140 is started (step S505). Then, it is judged whether the detection temperature $t_{th}$ reaches the sub/main change temperature $t_{ch}$ (step S506). When the detection temperature $t_{th}$ reaches the sub/main change temperature $t_{ch}$, the sub heater 124 is stopped (step S507), and then the sub heater heating time is preserved or stored (step S508) and the driving of the main heater is started (step S509).

Thereafter, the timer 140 is re-started (step S510), and the driving of the main heater 123 is continued until the detection temperature $t_{th}$ reaches the heater heating stop temperature $t_{off}$ (step S511). When the detection temperature $t_{th}$ reaches the heater heating stop temperature $t_{off}$, the main heater 123 is stopped (step S512), and then, the main heater heating time is preserved (step S513). Then, the value $t_{ch}$ is corrected as shown in FIG. 23.

First of all, the heating time $T_{s\ on}$ of the sub heater 124 is compared with the heating time $T_{m\ on}$ of the main heater 123 (step S601). If the heating time $T_{m\ on}$ of the main heater 123 is greater than the heating time $T_{s\ on}$ of the sub heater 124, the sub/main change temperature $t_{ch}$ is increased by a predetermined change amount $\Delta t$ (step S602); whereas, if the heating time $T_{s\ on}$ of the sub heater 124 is greater than the heating time $T_{m\ on}$ of the main heater 123, the sub/main change temperature $t_{ch}$ is decreased by a predetermined change amount $\Delta t$ (step S603). If the $T_{s\ on}$ is the same as $T_{m\ on}$, the value $t_{ch}$ is unchanged. The value $\Delta t$ is previously set to an appropriate value in accordance with the construction of the fixing device.

Figure 24:
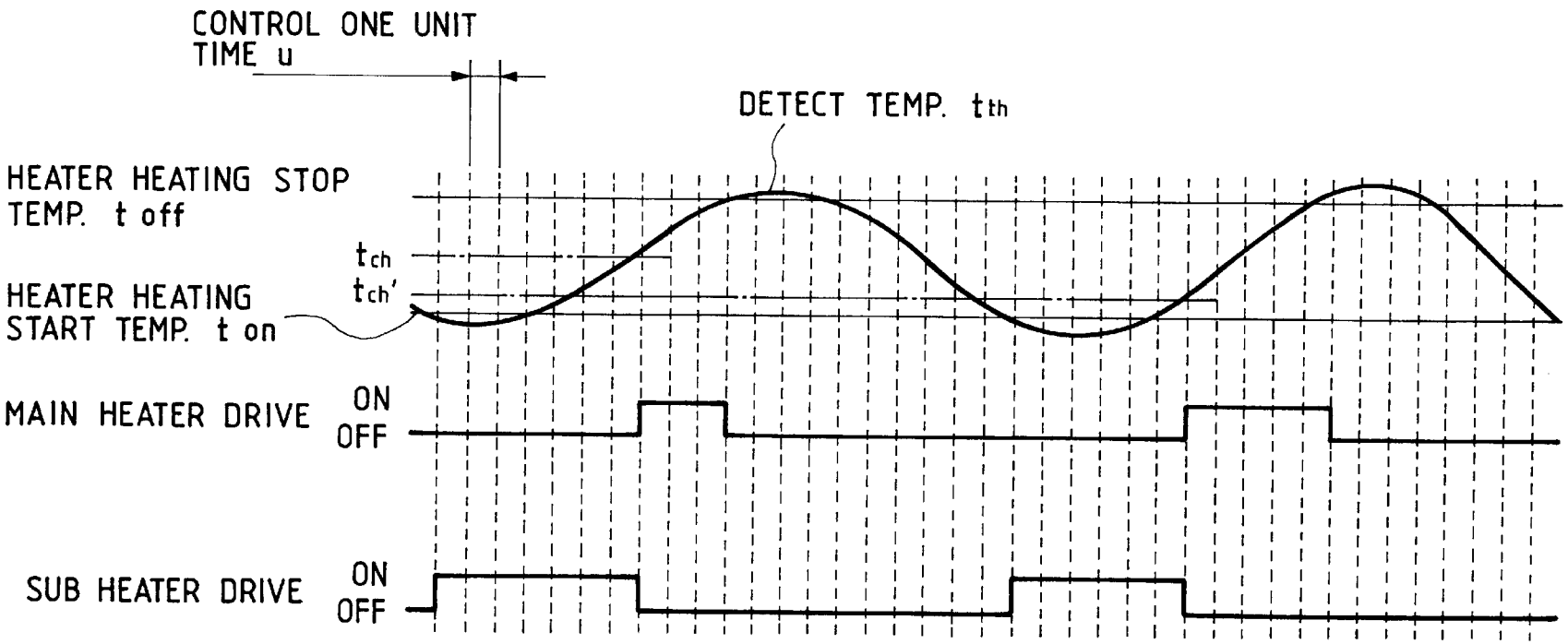
FIG. 24 is a timing chart schematically showing the control of the fixing heater according to the tenth embodiment.

The operation when the temperature adjustment is effected in this way in the stand-by condition is shown in FIG. 24. In FIG. 24, "u" denotes one unit time of heater control, i.e. control cycle. As shown, by correcting the previously set value $t_{ch}$ on the basis of the later main heater heating time, in the next heating, the heating time of the main heater and the heating time of the sub heater can be approached to each other.

Lastly, an eleventh embodiment of the present invention will be explained with reference to FIGS. 25 to 27. Incidentally, the same elements as those in the fifth embodiment are designated by the same reference numerals, and explanation thereof will be omitted.

In the eleventh embodiment, the temperature control is effected regarding one of the heaters in each time, the heating time of the sub heater is measured, the measured heating time is compared with the heating time of the main heater, and the heating stop temperature of the main heater. In this way, the heating time of the main heater and the heating time of the sub heater are made substantially the same as each other.

Figure 25:
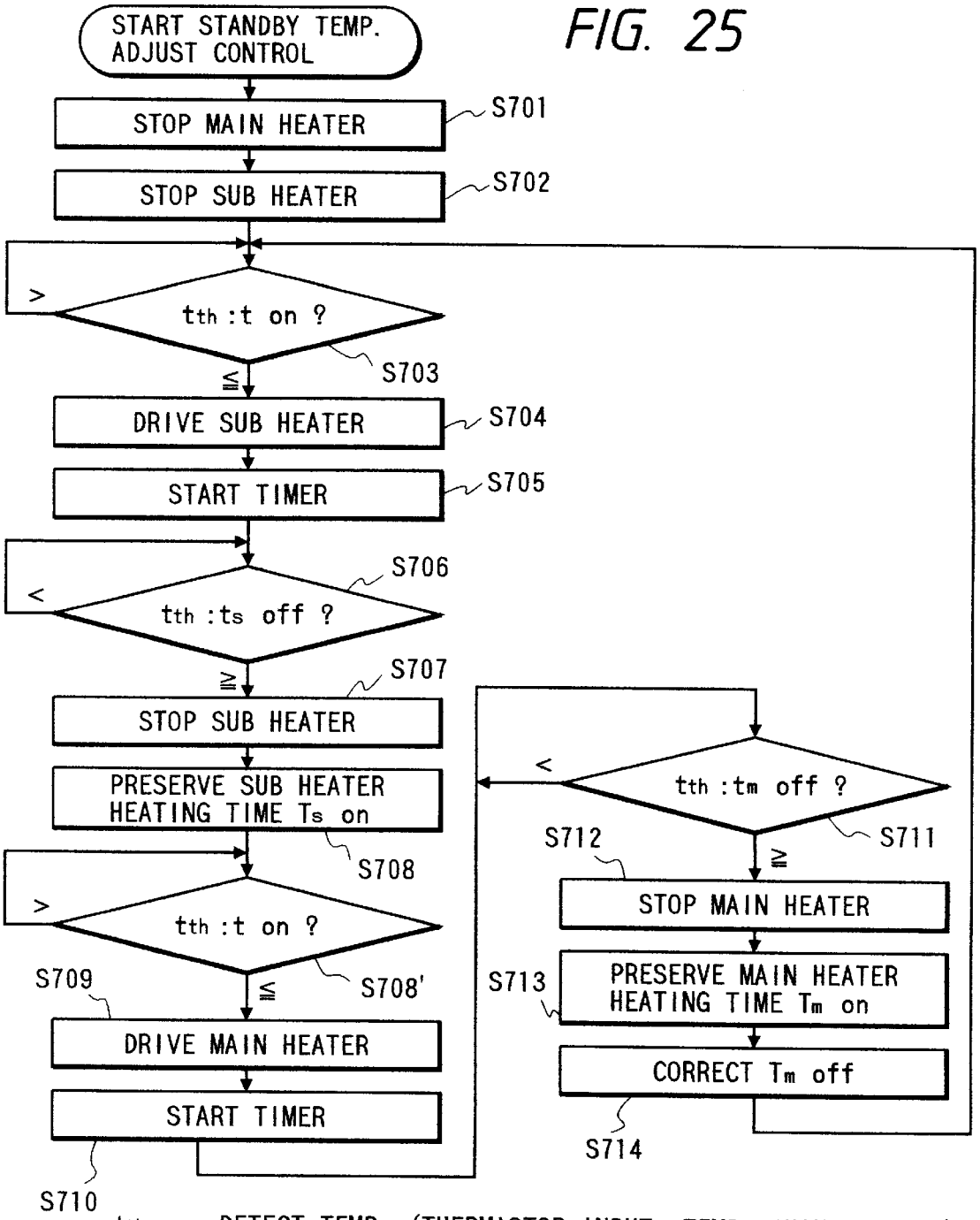
FIG. 25 is a flow chart showing the control of a fixing heater according to an eleventh embodiment of the present invention.
Figure 26:
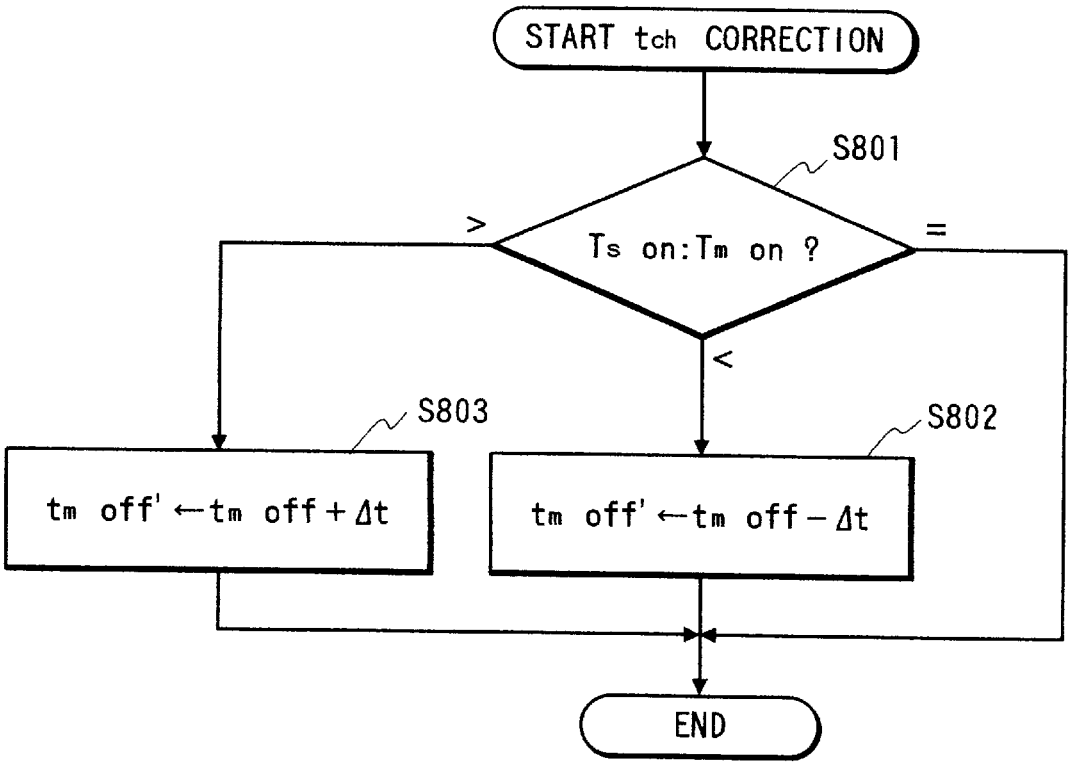
FIG. 26 is a flow chart showing a method for correcting a heater change timing, according to the eleventh embodiment.
Figure 27:
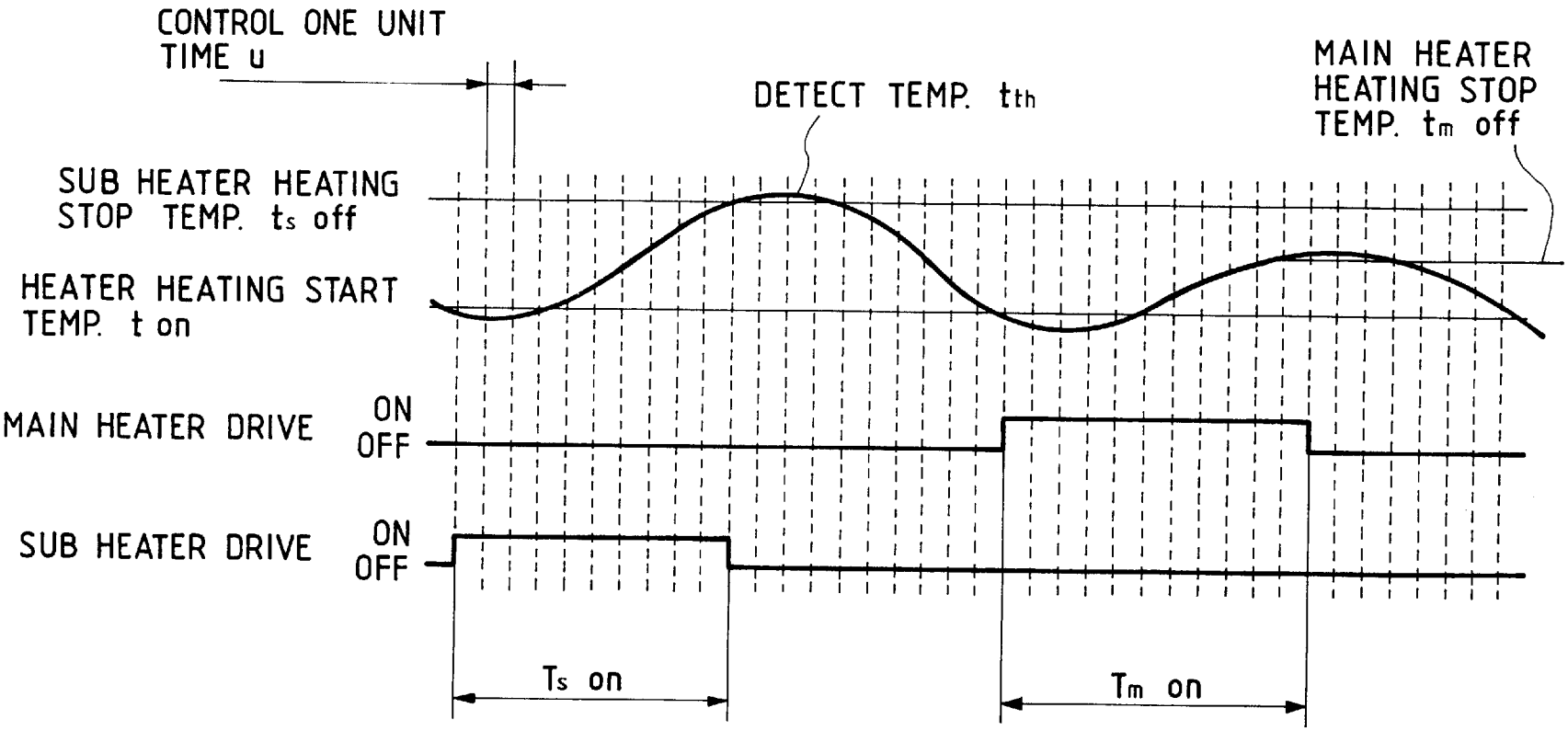
FIG. 27 is a timing chart schematically showing the control of the fixing heater according to the eleventh embodiment.

FIGS. 25 and 26 are flow charts showing the eleventh embodiment, and FIG. 27 is a timing chart.

The main heater 123 is stopped (step S701) and the sub heater 124 is stopped (step S702). Then, it is judged whether the detection temperature $t_{th}$ is decreased below the heater heating start temperature $t_{on}$ (step S703). When the detection temperature $t_{th}$ is decreased below the heater heating start temperature $t_{on}$, the driving of the sub heater 124 is started (step S704), and the timer 140 is started (step S705). Then, it is judged whether the detection temperature $t_{th}$ reaches the heating stop temperature $t_{s\ off}$ of the sub heater (step S706). When the detection temperature $t_{th}$ reaches the heating stop temperature $t_{s\ off}$, the sub heater 124 is stopped (step S707), and then the sub heater heating time $T_{s\ on}$ measured by the timer 140 is preserved or stored (step S708). Then, it is judged whether the detection temperature $t_{th}$ is decreased below the heater heating start temperature $t_{on}$ (step S708'). When the detection temperature $t_{th}$ is decreased below the heater heating start temperature $t_{on}$, the driving of the main heater 123 is started (step S709), and the timer 140 is started (step S710).

Thereafter, it is judged whether the detection temperature $t_{th}$ is increased above the heating stop temperature $t_{m\ off}$ of the main heater (step S711). When the detection temperature $t_{th}$ is increased above the heating stop temperature $t_{m\ off}$, the main heater 123 is stopped (step S712), and the heating time $t_{m\ on}$ of the main heater is preserved (step S713).

A default value stored in the memory is firstly used as the value $t_{m\ off}$. The default value is empirically selected to make the heating times of the main and sub heaters substantially the same as each other and is previously stored in the memory as a fixed value.

Then, the heating stop temperature $t_{m\ off}$ of the main heater is corrected to make the heating times of the main and sub heaters substantially the same as each other (step S714). The correction is shown in FIG. 26 in detail. The value $T_{s\ on}$ measured by the timer 140 is compared with the value $T_{m\ on}$ (step S801). If $T_{s\ on}<T_{m\ on}$, a value $t_{m\ off}'$ obtained by subtracting $\Delta t$ from the value $t_{m\ off}$ is preserved (step S802). If $T_{s\ on}>T_{m\ on}$, a value $t_{m\ off}''$ obtained by adding the main heater heating stop temperature adjust amount $\Delta t$ to the value $t_{m\ off}$ is preserved as a new value (step S803). If $T_{s\ on}=T_{m\ on}$, the correction is not effected. As the feature of this method, since the value $t_{s\ off}$ of the sub heater 124 having the heat generating areas nearer to the temperature detection position is generally greater than the value $t_{m\ off}$ of the main heater, by utilizing such a relation, if the value $t_{m\ off}$ becomes greater than the value $t_{s\ off}$, if can be judged that the abnormality occurs.

The operation when the temperature adjustment is effected in this way in the stand-by condition is shown in FIG. 27. As shown FIG. 27, according to this embodiment, the heating times of the main and sub heaters can be made substantially the same as each other.

Incidentally, in the above-mentioned embodiments, while an example that the heaters are disposed within the fixing roller was explained, the present invention is not limited to such an example, but, the present invention can be applied to a fixing apparatus having heaters disposed within both a fixing roller and a pressure roller, or to an image forming apparatus having such a fixing apparatus. Further, while an example that halogen heaters are used as the heaters was explained, the present invention is not limited to such an example, but, the present invention can be applied to a heat source such as a ceramic heater and the like. In addition, the fixing heater control device as the temperature control means may be incorporated into the fixing device or may be incorporated into the image forming apparatus independently from the fixing device.

Incidentally, in the above-mentioned embodiments, while an example that the fixing roller is used as the fixing member was explained, the present invention is not limited to such an example, but, a heat resistance film may be used as the fixing member and the heat resistance film may be slidingly contacted with a heater so that a pressure roller is urged against the heater with the interposition of the heat resistance film.

The present invention is not limited to the above-mentioned embodiments, but, various alterations and modifications can be effected within the scope of the invention.

What is claimed is:

1. An image heating apparatus comprising:

a first heater;

a second heater having a heat generating distribution different from that of said first heater;

a heated member to be heated by said first and second heaters;

a temperature detection element for detecting a temperature of said heated member, said temperature detection element being provided nearer to a heat generating area of said second heater than to a heat generating area of said first heater; and a power supply controlling means for controlling a power supply to said first heater and second heater on the basis of a temperature detected by said temperature detection element, wherein said power supply controlling means drives said first heater and second heater alternately;

wherein said power supply controlling means serves to stop the power supply to said first heater when the temperature detected by said temperature detection element reaches a first temperature and to stop the power supply to said second heater when the temperature detected by said temperature detection element reaches a second temperature higher than the first temperature.

2. An image heating apparatus according to claim 1, wherein said image heating apparatus is a fixing apparatus for heating and fixing a non-fixed image to a recording material, and said power supply controlling means serves to drive said first heater and second heater one by one in a stand-by condition prior to the heating of the non-fixed image.

3. An image heating apparatus according to claim 1, wherein said temperature detection element detects a temperature of an area of said heated member out of a minimum size recording material passing area.

4. An image heating apparatus comprising:

a first heater;

a second heater having a heat generating distribution different from that of said first heater;

a heated member to be heated by said first heater second heater;

a temperature detection element for detecting a temperature of said heated member, said temperature detection element being provided nearer to a heat generating area of said second heater than to a heat generating area of said first heater; and a power supply controlling means for controlling power supply to said first heater and second heater on the basis of a temperature detected by said temperature detection element wherein said power supply controlling means drives said first heater and second heater alternately;

wherein said power supply controlling means serves to drive said second heater for a predetermined time period when a detected temperature detected by said temperature detection element is lowered below a first temperature, and to drive said first heater until the detected temperature reaches a second temperature higher than the first temperature, after the predetermined time period is elapsed.

5. An image heating apparatus according to claim 4, wherein said image heating apparatus is a fixing apparatus for heating and fixing a non-fixed image to a recording material, and said power supply controlling means serves to drive said first heater and second heater one by one in a stand-by condition prior to the heating of the non-fixed image.

6. An image heating apparatus according to claim 4, wherein said temperature detection element detects a temperature of an area of said heated member out of a minimum size recording material passing area.

7. An image heating apparatus according to claim 4, further comprising a measuring means for measuring a power supply time to said first heater, and a power supply time correction means for correcting the predetermined time period on the basis of a measured value obtained from said measuring means.

8. An image heating apparatus comprising:

a first heater;

a second heater having a heat generating distribution different from that of said first heater;

a heated member to be heated by said first heater and second heater;

a temperature detection element for detecting a temperature of said heated member, said temperature detection element being provided nearer to a heat generating area of said second heater than to a heat generating area of said first heater; and a power supply controlling means for controlling a power supply to said first heater and second heater on the basis of a temperature detected by said temperature detection element, wherein said power supply controlling means drives said first heater and second heater alternately;

wherein said power supply controlling means serves to drive said second heater until a temperature detected by said temperature detection element reaches a second temperature after the detected temperature is lowered below a first temperature, and to drive said first heater until the detected temperature reaches a third temperature higher than the second temperature.

9. An image heating apparatus according to claim 8, wherein said image heating apparatus is a fixing apparatus for heating and fixing a non-fixed image to a recording material, and said power supply controlling means serves to drive said first heater and second heater one by one in a stand-by condition prior to the heating of the non-fixed image.

10. An image heating apparatus according to claim 8, wherein said temperature detection element detects a temperature of an area of said heated member out of a minimum size recording material passing area.

11. An image heating apparatus according to claim 8, further comprising a measuring means for measuring power supply times to said first heater and second heater, and a correction means for correcting the second temperature on the basis of measured values obtained from said measuring means.

* * * * *

UNITED STATES PATENT AND TRADEMARK OFFICE

CERTIFICATE OF CORRECTION

PATENT NO. : 5,819,134

DATED : October 6, 1998

INVENTORS : KAORU SATO, ET AL.

It is certified that error appears in the above-identified patent and that said Letters Patent is hereby corrected as shown below:

COLUMN 1,
Line 17, "heater" should read --heated and --;
Line 32, "aluminium" should read --aluminum--; and
Line 64, "printer," should read --printed,--.

COLUMN 3,
Line 4, "element." should read --element,--;
Line 5, "Wherein" should read --wherein--;
Line 20, "element." should read --element,--; and
Line 21, "Wherein" should read --wherein--.

COLUMN 5,
Line 22, "substantially" should read --substantially remains--.

COLUMN 6,
Line 45, "synchronous" should read --synchronism--.

COLUMN 14,
Line 61, "if" should read --it--; and
Line 65, "shown" should read --shown in--.

UNITED STATES PATENT AND TRADEMARK OFFICE

CERTIFICATE OF CORRECTION

PATENT NO. : 5,819,134

DATED : October 6, 1998

INVENTORS : KAORU SATO, ET AL.

It is certified that error appears in the above-identified patent and that said Letters Patent is hereby corrected as shown below:

COLUMN 16,
Line 1, "heater" should read --heater and--.

Signed and Sealed this

Twenty-eighth Day of September, 1999

*Attest:*

Q. TODD DICKINSON

*Attesting Officer*

*Acting Commissioner of Patents and Trademarks*